US006172648B1

(12) United States Patent
Tanizaki et al.

(10) Patent No.: US 6,172,648 B1
(45) Date of Patent: Jan. 9, 2001

(54) DIRECTIONAL COUPLER, ANTENNA DEVICE, AND TRANSCEIVER

(75) Inventors: Toru Tanizaki, Nagaokakyo; Ikuo Takakuwa, Suita; Hiroshi Nishida, Kawanishi; Atsushi Saitoh, Muko; Taiyo Nishiyama, Otsu; Nobuhiro Kondou, Hirakata; Nobumasa Kitamori, Nagaokakyo, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/346,815

(22) Filed: Jul. 2, 1999

(30) Foreign Application Priority Data

Jul. 3, 1998 (JP) ..... 10-189508
Dec. 28, 1998 (JP) ..... 10-373808

(51) Int. Cl.[7] ..... H01Q 3/02
(52) U.S. Cl. ..... 343/753; 343/753
(58) Field of Search ..... 343/700 MS, 906, 343/785, 788, 753, 700 R; 333/113, 254, 109, 248

(56) References Cited

U.S. PATENT DOCUMENTS 5,030,962 * 7/1991 Rees ..... 343/700 MS
5,770,989 * 6/1998 Ishikawa et al. ..... 333/248
5,917,232 * 6/1999 Tanizaki et al. ..... 257/664
5,920,245 * 6/1999 Ishikawa et al. ..... 333/248
5,933,120 * 8/1999 Manasson et al. ..... 343/788

* cited by examiner

*Primary Examiner*—Don Wong
*Assistant Examiner*—Chuc Tran D
(74) *Attorney, Agent, or Firm*—Ostrolenk, Faber, Gerb & Soffen, LLP

(57) ABSTRACT

In a directional coupler comprising two separated dielectric guides, reflection and loss in the separation position (separated faces) is reduced. Furthermore, the beam of an antenna device comprising a primary emitter and a dielectric lens can be tilted quickly even by a low-torque motor. A moving portion and a fixed portion each comprise dielectric guides, and in addition, grooves are provided in opposing end faces of conductive plates thereof, at a distance from the electrode faces of the dielectric guides of approximately an integral multiple of half the wavelength of the transmitted waves. Furthermore, the dielectric guide of the directional coupler portion is a normal NRD guide, and the dielectric guide of another portion is a hyper NRD guide.

7 Claims, 21 Drawing Sheets

FIXED PORTION MOVING PORTION

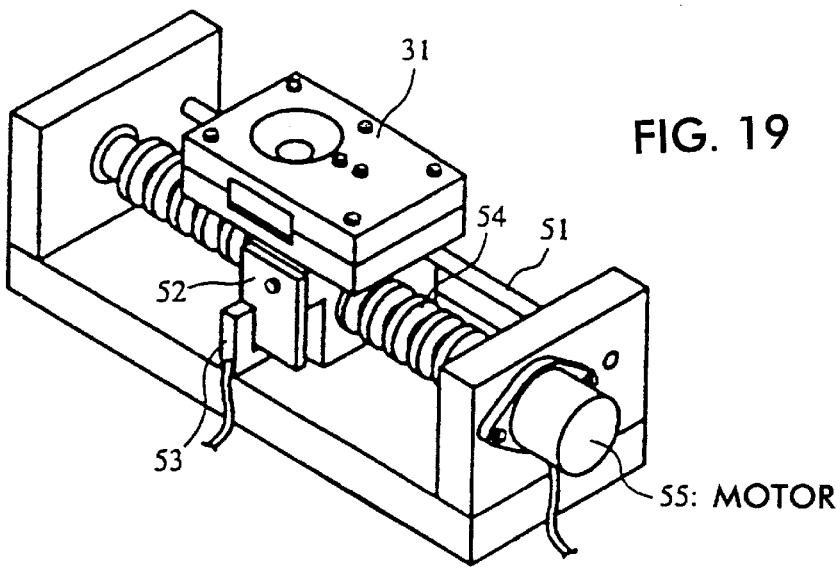
FIG. 19
FIG. 20A
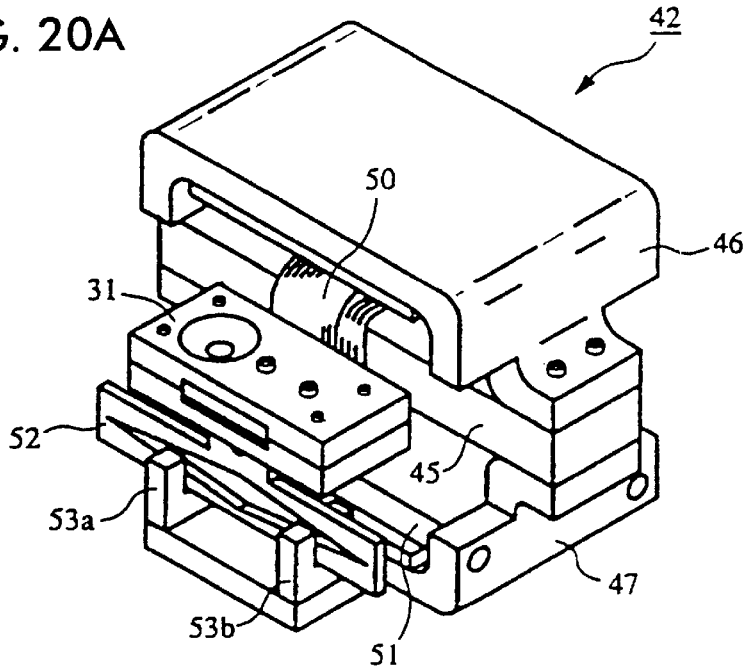
FIG. 20B
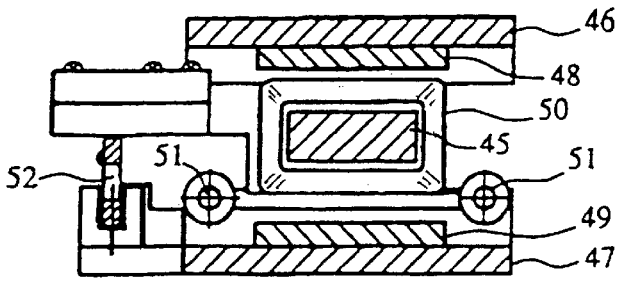

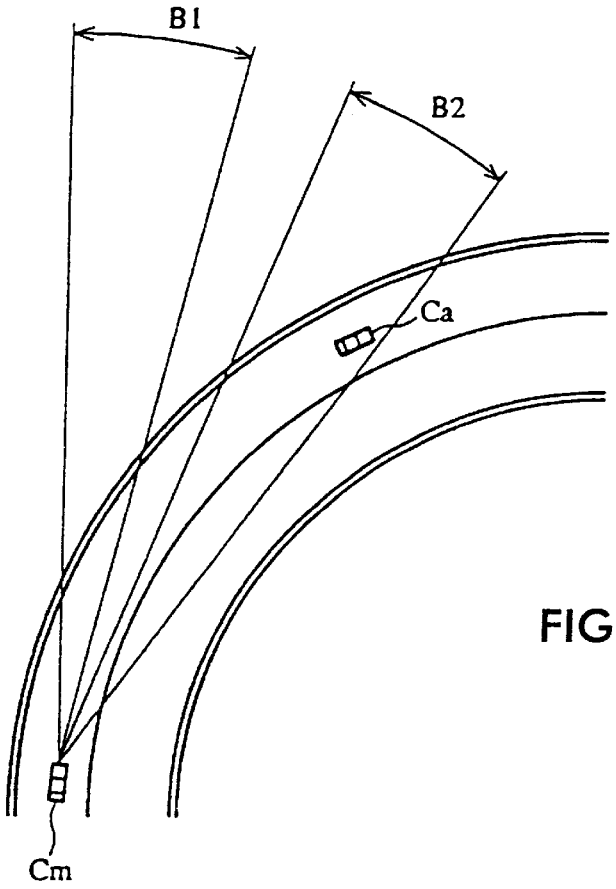
FIG. 23
FIG. 24
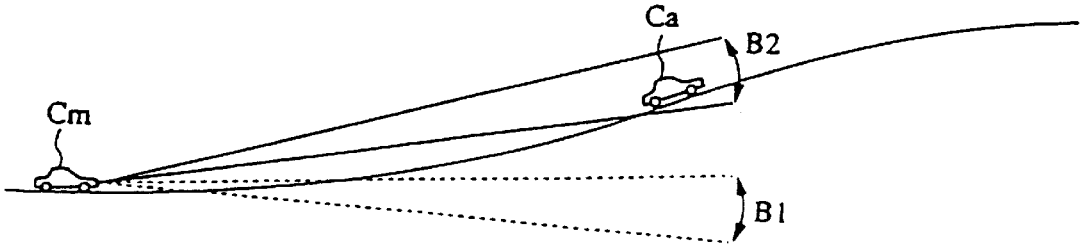

DIRECTIONAL COUPLER, ANTENNA DEVICE, AND TRANSCEIVER

BACKGROUND OF THE INVENTION

1. Field of the Invention

The present invention relates to a directional coupler using a dielectric guide, and to an antenna device and a transceiver using the directional coupler.

2. Description of the Related Art

Conventionally, a dielectric guide, comprising a dielectric strip provided between two conductive plates, is used as a guide for transmission in the milliwave band and the like. When forming a milliwave circuit using such dielectric guides, a directional coupler is used in a portion where electrical power is split between two dielectric guides.

A conventional directional coupler using dielectric guides comprises two dielectric strips, having a linear portion and a curved portion, which are provided at a predetermined distance apart between two conductive plates. The dielectric strips are arranged close together and the dielectric guides are coupled at this closely arranged portion.

A milliwave radar is an example of the milliwave circuit using dielectric guides described above. An antenna device used in a milliwave radar comprises a dielectric lens and a primary emitter provided at the focal point of the dielectric lens.

However, since the direction of the antenna in the conventional milliwave radar is fixed, in certain conditions it is not possible to achieve the intended sensitivity and measurements, as will be explained below. For instance, as shown in FIG. 22, when a vehicle is traveling on a multi-lane road, it is not possible to determine immediately whether other vehicles in front of it are traveling in the same lane based only on waves reflected from the other vehicles. That is, in FIG. 22, when the vehicle Cm emits a beam B2, it picks up not only waves reflected from the vehicle Ca which is traveling in front, but also waves reflected from the vehicle Cb which is traveling in the opposite lane. Furthermore, as shown in the example of FIG. 23, when the vehicle Cm emits a beam B1 in the forward direction, it is unable to detect the vehicle Ca which is traveling in front in the same lane. Moreover, as shown in FIG. 24, when traveling on an curving road, even though the vehicle Cm emits a beam B1 in the forward direction, it cannot detect the vehicle Ca in front of it.

One conceivable solution is to provide an antenna device, combining a primary emitter and a dielectric lens, in which the direction of the beam is tilted by changing the position of the primary emitter. In order to change the position of the primary emitter, the configuration should be arranged so that the dielectric guide connecting to the primary emitter and the other dielectric guide connecting to the circuit can be relatively displaced while remaining coupled with low loss. To achieve this, the configuration of the directional coupler using dielectric guides described above need only be arranged so that two dielectric guides can be relatively displaced.

However, the separated positions (separated faces) of the two dielectric guides of the directional coupler are parallel to the two dielectric strips provided closely together. With this configuration, the end faces of the conductive plates on either side of the dielectric strips are provided parallel to the direction of propagation of the electromagnetic waves of the two dielectric guides, and consequently the path of the current flowing through the conductive plates is broken at the end face portions of the conductive plates, causing reflection. As a result, there are problems such as the creation of unwanted modes other than the propagation mode, increased loss, or an inability to obtain desired characteristics of the directional coupler, etc.

The above example describes case where the two dielectric guides of the directional coupler portion are relatively displaced, but the directional coupler can be used when forming a single device incorporating circuit modules using dielectric guides, to couple the dielectric guides between the circuit modules. In this case too, the path of the current flowing through the conductive plates is broken between the circuit modules, causing reflection. As a result, there are problems of increased loss and inability to obtain desired signal transmission characteristics between the circuit modules.

SUMMARY OF THE INVENTION

Accordingly, it is an object of the present invention to provide a directional coupler comprising two separated dielectric guides, wherein the above problems of reflection and loss are eliminated.

To provide dielectric strips of two dielectric guides of a directional coupler close together in a predetermined region only, a bend must be provided in dielectric guide portions joined to the directional coupler. However, to reduce loss due to conversion from the LSM mode to the LSE mode, for instance, the radius of curvature of the bend must be large. As a result, the overall size of the device is increased, and when it is used to form an antenna device, the moving portion cannot be made light, making it difficult to deflect the beam quickly. On the other hand, when the space between opposing faces of the two conductive plates clasping the dielectric strip is made narrow, although the radius of curvature of the bend can be set freely as long as dielectric guides transmitting only in the LSM01 mode as used, the coupling portion must be made long in order to obtain adequate coupling, inevitably increasing the overall size of the device and making it difficult to lighten the moving portion. If the space between the dielectric strips in the coupling portion is extremely narrow, strong coupling can be obtained, but the characteristics of the directional coupler will greatly depend on the precision of the positioning of the two separated dielectric guides.

It is another object of the present invention enable the directional coupler and a device using the directional coupler to be easily miniturized, to enable the mass of the moving portion to be reduced, and to enable the direction of the beam to be deflected quickly.

The directional coupler of the present invention comprises first and second dielectric guides, each comprising a dielectric strip provided between two conductive plates, arranged with the end faces of the conductive plates touching or not touching, and the dielectric strips of the first and second dielectric guides are provided substantially parallel to each other in the vicinity of the end faces of the conductive plates, so that the first and second dielectric guides are structurally separate. Furthermore, a groove is provided in an end face of the conductive plates of one of the first and second dielectric guide, the groove having a short-circuiting face in a position at a distance from the electrode faces of approximately an integral multiple of half the wavelength of a propagated wave.

With this configuration, the electrode faces in the portion where the end faces of the conductive plates of the first and second dielectric guides are aligned function as an equivalently continuous portion. Therefore, although the two dielectric guides are separated by the conductive plate portions, there is almost no loss in this space. Furthermore, since there is almost no reflection, no spurious modes are caused by reflection.

Furthermore, in the present invention, a position at a distance from the electrode face of approximately an integral multiple of half the wavelength of a plane wave, which travels in a direction such that it has a wave-number vector component equal to a phase constant of a transmitted wave propagating through the dielectric guides, in the direction of a transmitted wave propagating through the dielectric guides, is a short-circuiting face.

A plane wave, propagating through the aligned portion of the end faces of the conductive plates of the first and second dielectric guides, travels in a direction determined according to its size and the size of a transmission wave, propagating along the length of the dielectric guides. That is, the size of the plane wave (wave-number k) is predetermined, and when the plane wave is projected in the transmission direction of the dielectric guides, the plane wave proceeds in a direction (θ) which matches the phase constant of a transmission wave propagating through the dielectric guides. Therefore, when a groove is provided as a short-circuiting face at a distance from the electrode face of approximately an integral multiple of half the wavelength of a plane wave in that direction, the problem of reflection is avoided to an optimum degree.

Furthermore, the present invention further comprises a first type of nonradiative dielectric guide comprising the approximately parallel dielectric strip portions and the electrode faces, and a second type of nonradiative dielectric guide, wherein the space between the electrode faces other than those of the approximately parallel dielectric strip portions is narrower than the height of the approximately parallel dielectric strip portions, and comprising a dielectric strip portion other than the approximately parallel dielectric strip portions and the electrode faces, and transmitting in a single LSM01 mode. Then, a guide conversion portion is provided between the first and second types of nonradiative dielectric guide. Consequently, coupling can easily be achieved in the first type of nonradiative dielectric guide portion, without increasing the length of the parallel dielectric strip portions or greatly narrowing the space between them. In addition, in the second type of nonradiative dielectric guide portion, there is no conversion to the LSE mode even when a bend with a short radius of curvature is provided, thereby enabling the entire device to be miniturized without increasing transmission loss.

Furthermore, according to the present invention, a primary emitter is coupled to a first dielectric guide of the above directional coupler, and a dielectric lens is secured approximately at the focal point of the primary emitter. With this configuration, when the first dielectric guide is displaced in relation to a second dielectric guide, the primary emitter is displaced within the focal point inner face of the dielectric lens, tilting the direction of the beam. Moreover, there is little loss in the directional coupler portion, and the moving portion can be miniturized and of low mass by providing the first and second types of nonradiative dielectric guides on the side of the first dielectric guide. Further, by providing the first and second types of nonradiative dielectric guides to the second dielectric guide, a miniturized antenna device can be obtained.

When the directional coupler is arranged so that the amount of coupling between the first dielectric guide and the second dielectric guide of the directional coupler is approximately 0 dB, transmission signals and received signals can be transmitted most efficiently between the moving portion and the fixed portion, increasing the efficiency of the antenna.

Furthermore, in the present invention, a transmission signal is sent from a transmitter to the second dielectric guide, and input/output ports of a circulator for sending a received signal from the second dielectric guide to a receiver are connected to the second dielectric guide. With this configuration, it is possible to realize an antenna device for transmitting and receiving, in which the direction of the beam can be tilted using a single primary emitter and a single directional coupler.

Furthermore, the present invention comprises a transceiver wherein a transmitter is connected to an input port of the circulator, and a receiver is connected to an output port of the circulator.

BRIEF DESCRIPTION OF THE DRAWINGS

FIGS. 1A to 1C show configurations of a directional coupler and an antenna device according to a first embodiment;

FIGS. 7A to 7C are diagrams showing a cross-sectional configuration of two types of directional coupler;

FIG. 19 is a perspective view of an example configuration of a forward-screw system;

FIGS. 20A and 20B are diagrams showing an example configuration of a voice-coil motor

FIG. 23 is a diagram showing the state when the emitted beam of the milliwave radar for a vehicle is tilted horizontally;

FIG. 24 is a diagram showing the state when the emitted beam of a milliwave radar for a vehicle is tilted vertically;

DESCRIPTION OF THE PREFERRED EMBODIMENTS

The configurations of a directional coupler and an antenna device according to a first embodiment of the present invention will be explained with reference to FIGS. 1A to 11.

Figure 1A:
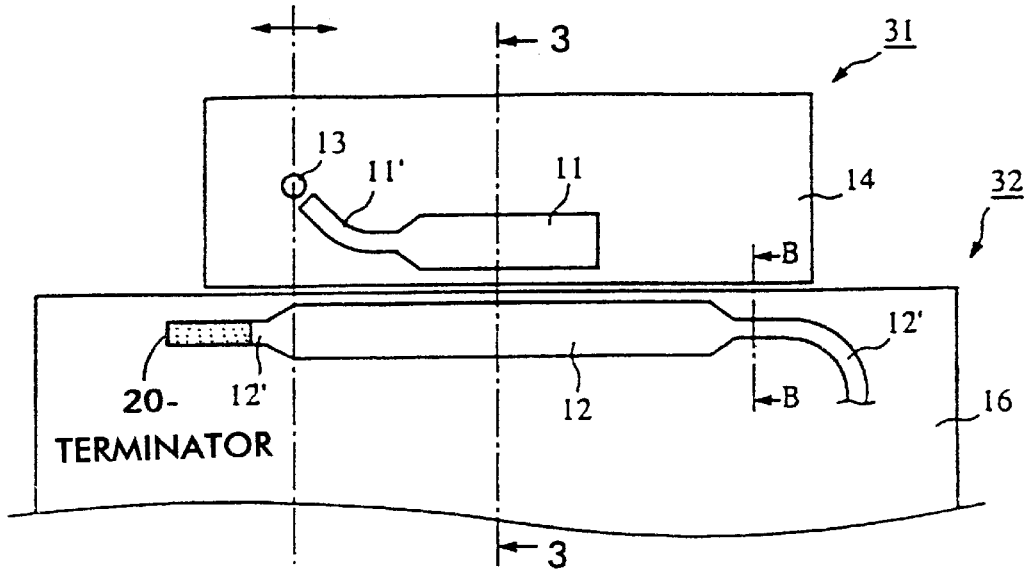
Figure 1B:
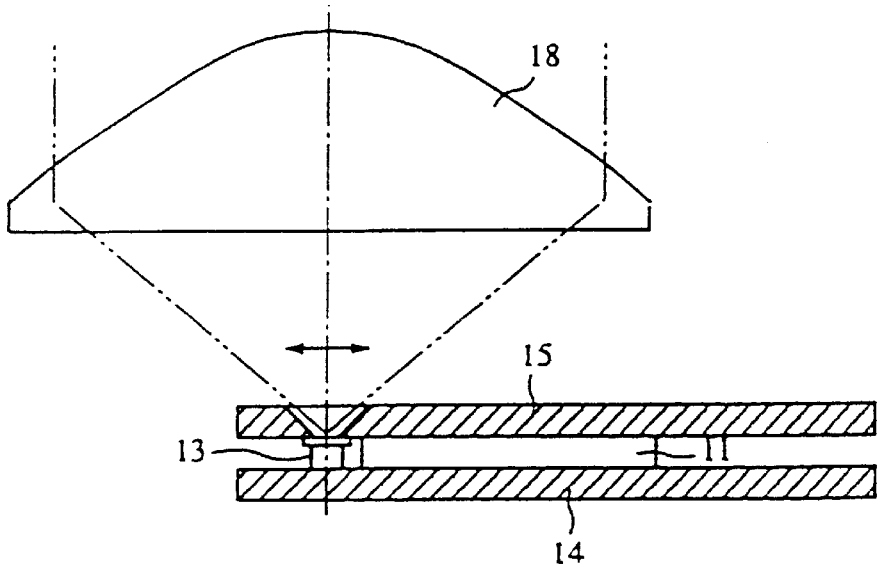

FIGS. 1A and 1B show the relation between the configuration of a directional coupler and a primary emitter and a dielectric lens. In FIG. 1A is a top view of the state when the upper conductive plate is removed, and FIG. 1B is a cross-sectional view through the primary emitter portion. In FIG. 1A, a moving portion 31 can be displaced with respect to a fixed portion 32 in the direction indicated by the arrows. In the moving portion 31, numeral 14 represents a lower conductive plate and numeral 11 represent a dielectric strip. The dielectric strip 11 is provided between an upper conductive plate and the lower conductive plate 14, thereby forming a first nonradiative dielectric guide (hereinafter "NRD guide"). In the fixed portion 32, numeral 16 represents a lower conductive plate and 12 is a dielectric strip. The dielectric strip 12 is provided between an upper conductive plate and the lower conductive plate 16, thereby forming a second NRD guide.

The end faces of the conductive plates of the first and second NRD guides are provided with a predetermined gap in between so that they do not contact each other. The dielectric strips 11 and 12 of the first and second NRD guides are provided close together in parallel near the end faces of the conductive plates 14 and 16. Thus a directional coupler is formed, comprising the first and second NRD guides.

Dielectric strip portions, shown in FIG. 1 by the portions 11' and 12', and the upper and lower conductive plates clasping them, form NRD guides (hereinafter "hyper NRD guides") which transmit in a single mode, LSM01 mode.

A primary emitter 13, comprising a cylindrical rod-like dielectric resonator, is provided at an end of the dielectric strip 11' of the moving portion 31. As shown in FIG. 1B, an opening, having a horn-like taper, is provided in the upper conductive plate 15 and is coaxial to the primary emitter 13. As shown in the diagram, a slit plate, comprising a conductive plate with a slit in it, is inserted between the primary emitter 13 and the opening. As a consequence, electromagnetic waves are propagated in the dielectric strip 11' in an LSM mode carrying electrical field components at a right angle to the length of the dielectric strip 11' and parallel to the conductive plates 14 and 15, and carrying magnetic field components in a direction perpendicular to the conductive plates 14 and 15. The dielectric strip 11' and the primary emitter 13 are electromagnetically coupled, generating an HE111 mode carrying electrical field components inside the primary emitter 13 in the same direction as the electrical field of the dielectric strip 11'. Then, vertically polarized electromagnetic waves are emitted through the opening in a direction perpendicular to the conductive plate 14. The dielectric lens 18 converges these waves into a predetermined beam. Conversely, when electromagnetic waves are emitted through a dielectric lens into the opening, the primary emitter 13 is excited in the HE111 mode, and electromagnetic waves are propagated in the LSM mode to the dielectric strip 11' coupled to it.

A terminator 20 is provided at one end of the dielectric strip 12' on the fixed portion 32 side. With this configuration, transmission signals are input to the hyper NRD guide comprising the other dielectric strip 12', which outputs received signals.

Figure 2A:
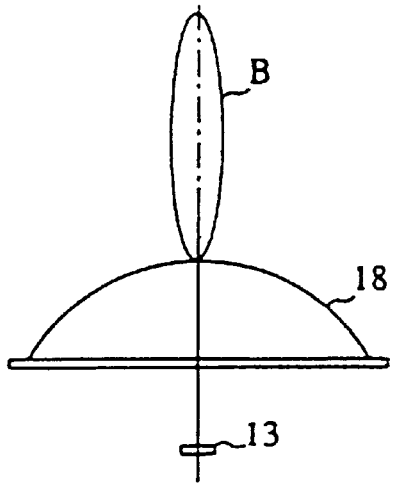
FIGS. 2A to 2C are diagrams showing the relation between relative positions of a dielectric lens and a primary emitter and the direction of a beam.
Figure 2B:
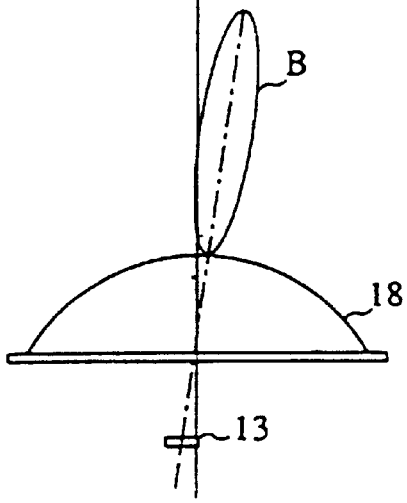
Figure 2C:
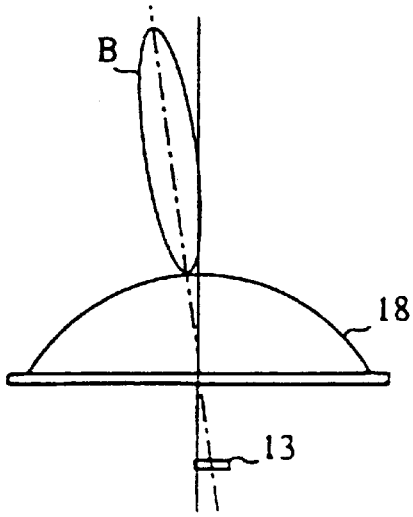

FIG. 2 shows changes in direction of the beam due to displacement of the primary emitter. The primary emitter 13 is positioned approximately at the focal point of the dielectric lens 18, and the transmitted/received beam B is deflected to the left and right as shown in FIG. 2 by displacing the focal point of the inner face (by displacing the moving portion 31 in relation to the fixed portion 32 shown in FIG. 1A)

Figure 3:
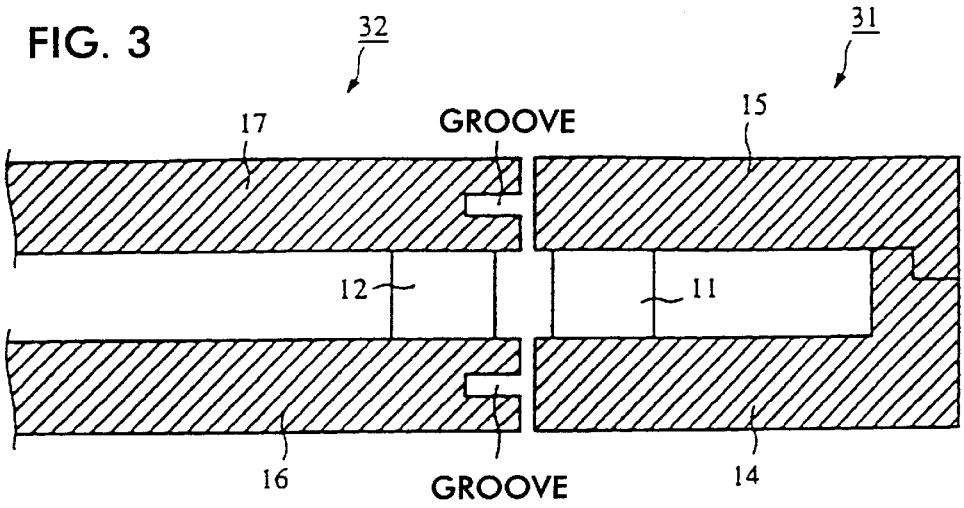
FIG. 3 is a cross-sectional view of a directional coupler portion.

FIG. 3 is a cross-sectional view taken along the line A—A of FIG. 1A. The first NRD guide on the moving portion side comprises the upper and lower conductive plates 14 and 15, and the dielectric strip 11 provided between them. The second NRD guide on the moving portion side comprises the upper and lower conductive plates 16 and 17, and the dielectric strip 12 provided between them. The end faces of the conductive plates of the first and second NRD guides are arranged opposite each other with a predetermined gap between them, and predetermined grooves running parallel to the conductive plates 16 and 17 are provided in the end faces of the conductive plates 16 and 17.

Figure 4A:
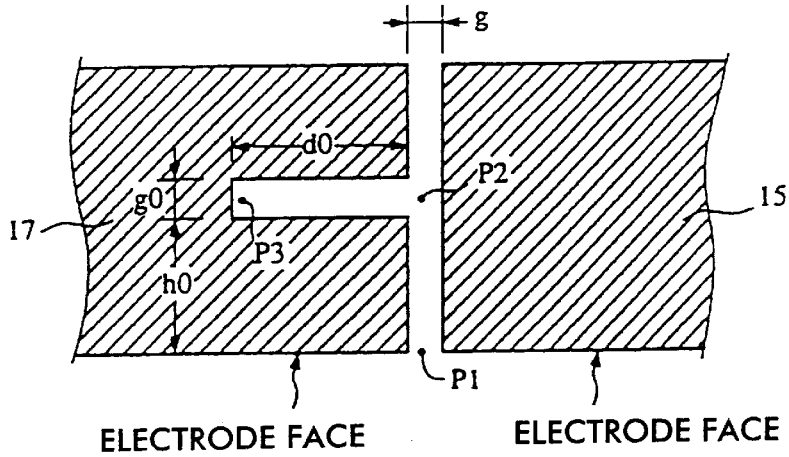
FIGS. 4A to 4B are partial cross-sectional views of the configuration of end faces of conductive plates of a directional coupler.

FIG. 4 shows two examples of the configuration of the above grooves. In example FIG. 4A, a groove of depth d0 and thickness g0 is provided at a distance of h0 from the electrode face (the opposing faces of the upper and lower conductive plates). Here, g0 is equal to the gap g between the conductive plates 15 and 17. Further, h0=d0, these lengths being an odd multiple of a quarter of the wavelength of the electromagnetic waves propagating through the gap. Since the end P3 of the groove is a short-circuiting terminal, a point P2, which is a distance d0 from the end P3, is an equivalently open point, and a point P1, which is a distance h0 from the point P2, is an equivalently short-circuiting point (short-circuiting face). Therefore, the electrode faces of conductive plates 15 and 17 are equivalently continuous.

Figure 4B:
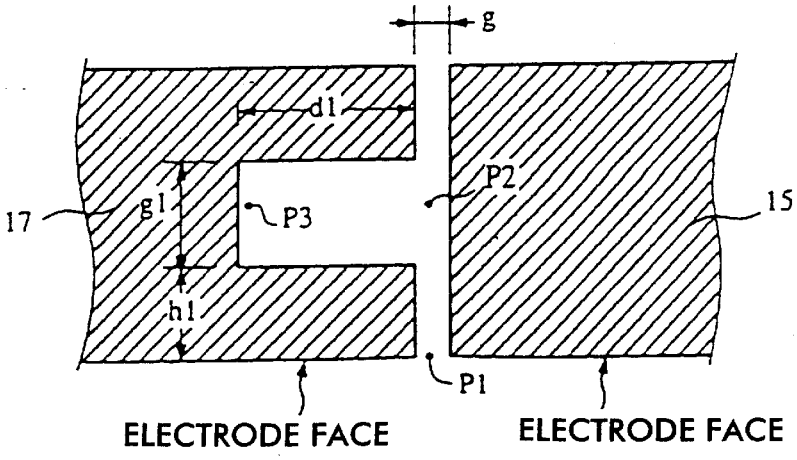

As shown in the example of FIG. 4B, the width g1 of the groove is wider than the gap g of the conductive plates 15 and 17. In such a configuration, the position, depth, and width of the groove should be set so that the position of P1, as viewed from the short-circuited face P3, is an equivalently short-circuited face. Normally, the greater the width g1 of the groove, the shorter the distance h1 from the electrode face to the groove, and consequently it is possible to make the point P2 portion between the two conductive plates an equivalently open point. When the portion between the two conductive plates is made an open terminal in this manner, no current flows to the conductive plates, thereby reducing conductive loss.

Although the two NRD guides, comprising a moving portion and a fixed portion, are separated at the conductive plate portion, their electrode faces are equivalently continuous, and so almost no loss is caused by the presence of the gap. Furthermore, since there is almost no reflection in the space, no spurious mode is caused by reflection.

Figure 5A:
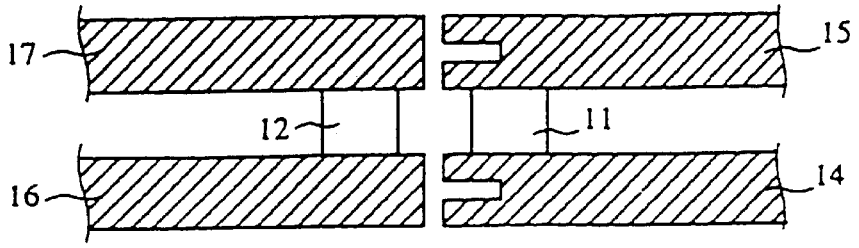
FIGS. 5A to 5E are cross-sectional views of various example configurations of a directional coupler.
Figure 5B:
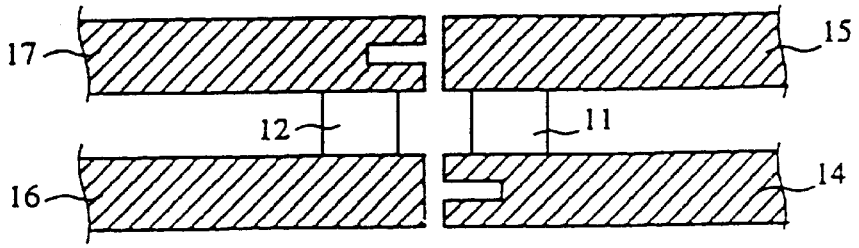
Figure 5C:
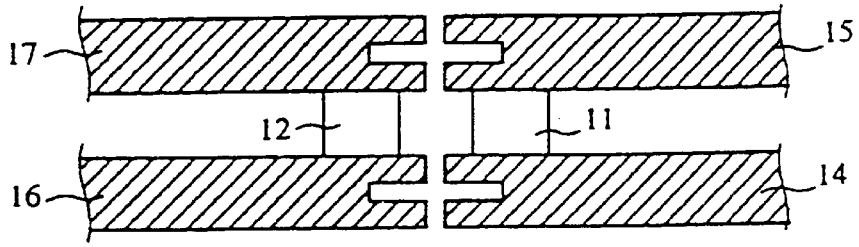
Figure 5D:
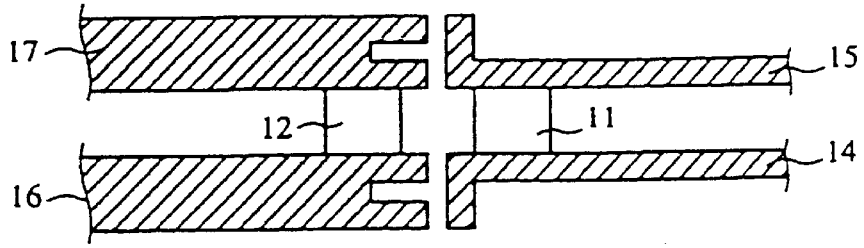
Figure 5E:
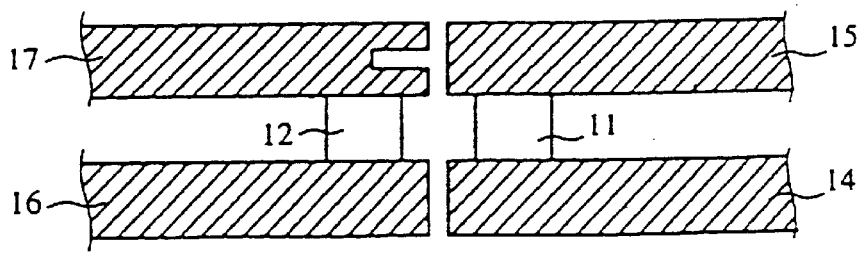

FIGS. 5A to 5E show cross-sectional views of other configurations of a coupling portion between two NRD guides. In the example shown in FIG. 3, grooves were provided in the end faces of both the upper and lower conductive plates; however, as shown in FIG. 5A, grooves can be provided not only in the fixed portion side but also in the moving portion side. Furthermore, as shown in example FIG. 5B, grooves can be provided in opposite parts of the upper and lower conductive plates of the fixed portion and the moving portion. Alternatively, as in example FIG. 5C, the grooves can be provided facing each other on both sides. The thicknesses of the conductive plates of the fixed portion and the moving portion do not necessarily have to be the same, but when they differ, the opposing end faces of the conductive plates should have the same thickness, as in FIG. 5D. When the conductive plates 14 and 15 on the moving portion side are made thin overall, the overall size and weight of the moving portion can be made small, enabling it to be displaced easily using even a low-torque motor. Furthermore, as shown in FIG. 5E, a groove may be provided in just one of the conductive plates, to achieve a desired effect.

In the example shown in FIG. 4, in a 60 GHz band, g=g0=0.2 mm, h0=d0=1.2 mm. In FIG. 4B, g=0.2 mm, g1=1.0 mm, h1=0.96 mm and d1=1.5 mm. In this example, the distance from the end P3 of the groove to the electrode face P1 was half the wavelength of the propagated waves, but this distance need only be $n\lambda/2$, where n is a whole number greater than 1, and $\lambda$ is the wavelength. Furthermore, the distance from the electrode face P1 and the groove end P3 to the midpoint P2 should be $(2m-1)\lambda/4$ (where m is an integer greater than 1). The longer the distance from point P1 to point P3, the narrower the width of the frequency band in which the point P1 can function equivalently as a short-circuited face, and for this reason, the distance from point P1 and point P3 to the midpoint P2 should be approximately $\lambda/4$ to obtain the above effect over a wide band.

Figure 6A:
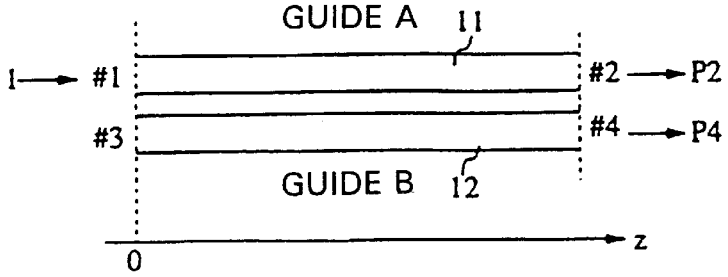
FIGS. 6A and 6B are diagrams showing the relation between the configuration of a directional coupler and its characteristics.
Figure 6B:
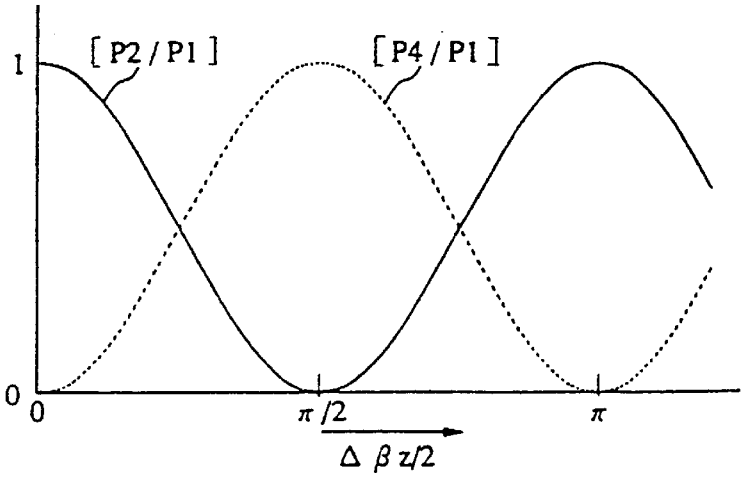

FIG. 6 shows the relation between the directional coupler described above and the power splitting ratio. Now, if the phase constant of the even modes of the coupled guides, comprising the dielectric strips 11 and 12, is expressed as $\beta e$, the phase constant of the odd modes as $\beta o$, and $\Delta\beta=|\beta e-\beta o|$, and the power ratio between an electromagnetic wave input from port #1 and an electromagnetic wave output to port #2 is expressed by $P2/P1=1-\sin^2(\Delta\beta z/2)$, and the power ratio between an electromagnetic wave input from port #1 and an electromagnetic wave output to port #4 is expressed by $P4/P1=1-\sin^2(\Delta\beta z/2)$. Therefore, with a constant of $(\Delta\beta z/2)=n\pi+\pi/2$(n: 0, 1, 2 . . . ), the entire input from the port #1 is output to the port #4, forming an 0 dB directional coupler.

Figure 7A:
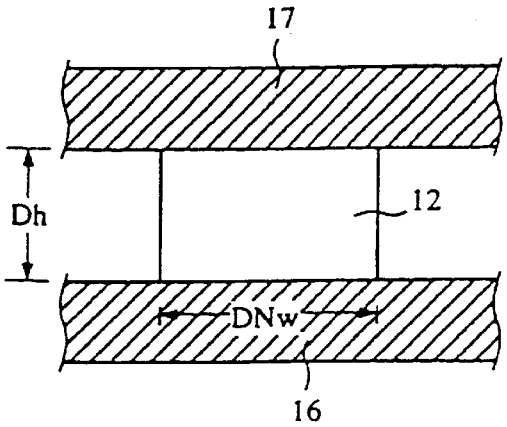
Figure 7B:
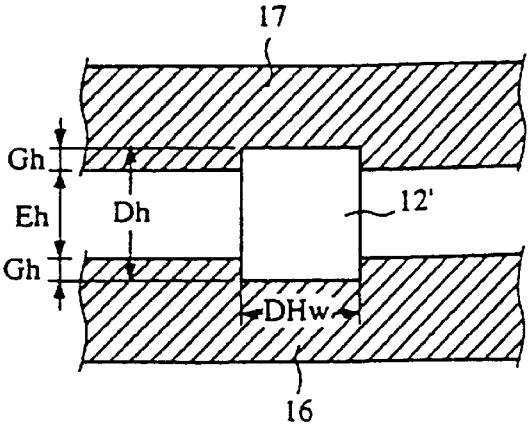

FIGS. 7A and 7B show the cross-sectional configurations of the hyper NRD guide and the normal NRD guide portion in the directional coupler shown in FIG. 1. FIG. 7A is a cross-sectional view of the NRD guide 12 taken along the line A—A of FIG. 1, and FIG. 7B is a cross-sectional view taken along the line B—B in FIG. 1. As shown in FIG. 7A, in the normal NRD guide, the space Dh between the electrode faces of the conductive plates 16 and 17 is equal to the height of the dielectric strip 12. As shown in FIG. 7B, in the hyper NRD guide, grooves of depth Gh are provided in the conductive plates 16 and 17, so that the space Eh between the electrode faces of the conductive plates 16 and 17 is narrower than the height Dh of the dielectric strip 12'. In addition to providing these grooves, the space between the propagation region of the dielectric strips and the conductive break plate in the nonpropagation region where there are no dielectric strips is determined, the dielectric constants of the dielectric strips are determined, and the cut-off frequency of the LSM01 mode is set lower than the cut-off frequency of the LSE01 mode, and the cut-off frequency of the LSE01 mode is set higher than the frequency used. With this configuration, waves can always be transmitted in a single mode, the LSM01 mode, irrespective of the radius of curvature and the like of the bends of the dielectric strips. Consequently, the overall directional coupler can be made small with reduced loss.

When signals are transmitted at a single frequency, the width DHw of the dielectric strip 12' of the hyper NRD guide is smaller than the width DNw of the dielectric strip 12 of the normal NRD guide. For instance, in a band of 60 GHz, if the specific dielectric constant $\in r$ of the dielectric strips is 2.04, then Dh=2.2 mm, DNw=3.0 mm, Gh=0.5 mm, Eh=1.2 mm and DHw=1.8 mm.

Figure 8:
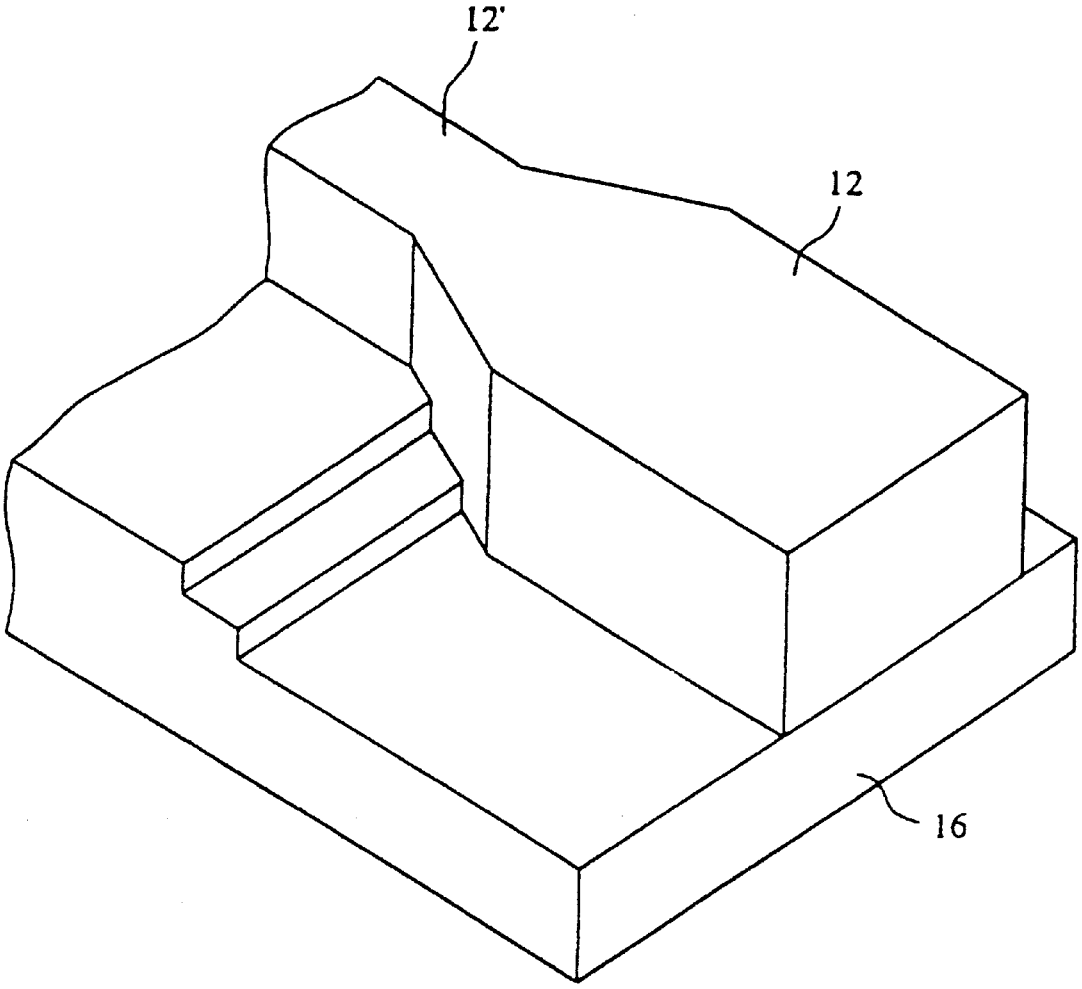
FIG. 8 is a perspective view of a configuration of a guide converter portion.
Figure 9A:
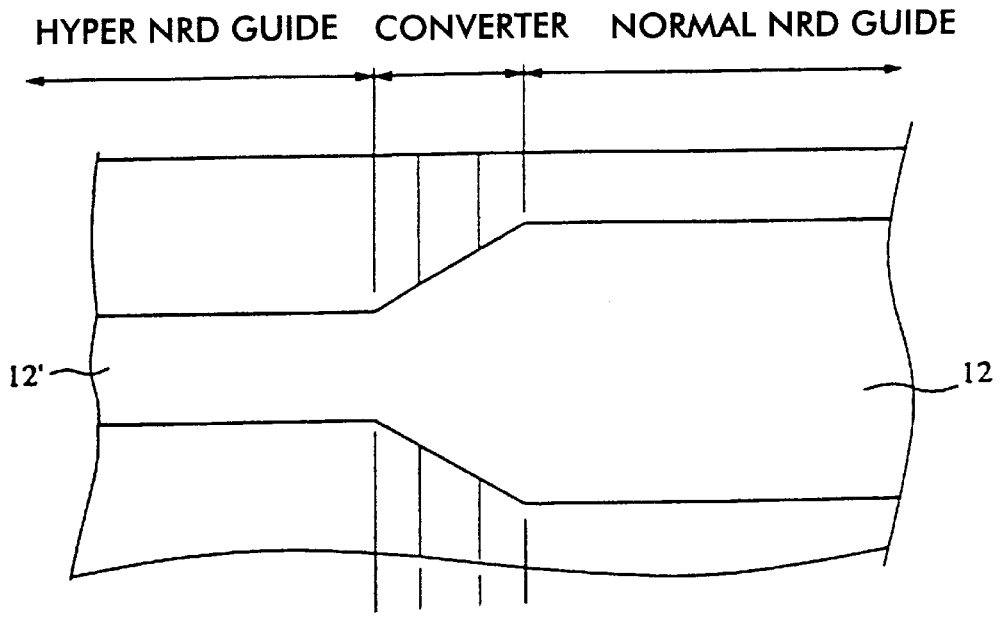
FIGS. 9A and 9B are a top view and a cross-sectional view, respectively, of the configuration of the same guide converter portion.
Figure 9B:
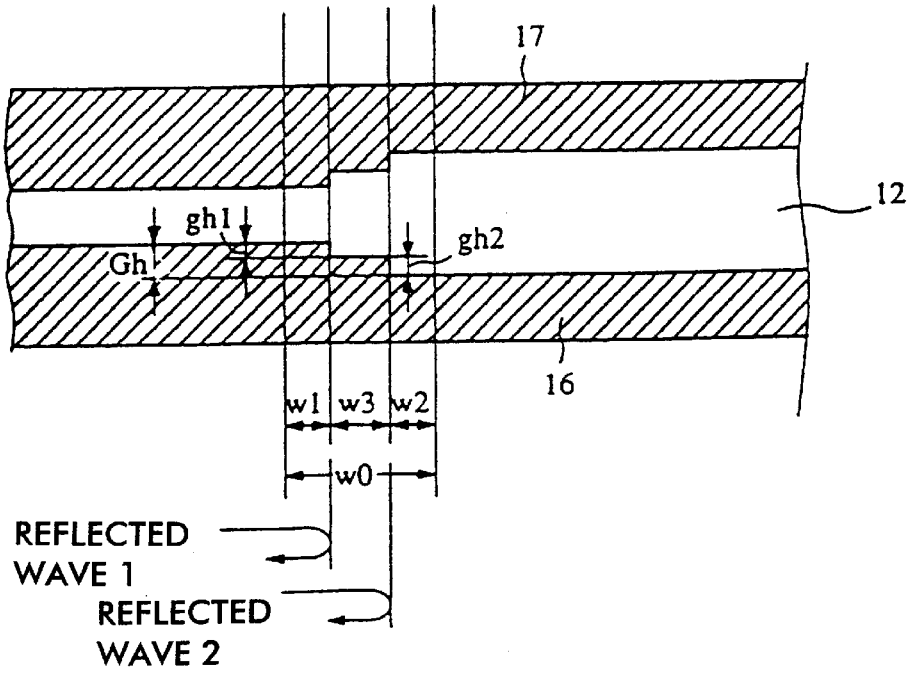

FIG. 8 is a perspective view of the configuration of a normal NRD guide, a hyper NRD guide, and a guide converter. FIG. 9 shows a top view and a cross-sectional view of the same. FIG. 8 and FIG. 9 show states when the upper conductive plate has been removed. As shown in these diagrams, the converter portion of the hyper NRD guide and the normal NRD guide is tapered so as to gradually eliminate the dimensional difference in the widths of the dielectric strips of the NRD guides. Furthermore, the space between the electrode faces of the conductive plates 16 and 17 changes in stages. That is, the space between the electrode faces of the hyper NRD guide does not change from the position of the interface between the hyper NRD guide and the converter to w1. Similarly, the space between the electrode faces of the normal NRD guide does not change from the position of the interface between the normal NRD guide and the converter to w2. However, in the portion between w1 and w2, the spaces between the electrode faces of the normal NRD guide and the hyper NRD guide have an intermediate value. For instance, w1=w2=0.75 mm, w0=3.0 mm, gh1=0.13 mm, gh2=0.37 mm. Here, w3 corresponds to approximately one-quarter of the wavelength of the propagated waves. Consequently, a reflected wave 1 and a reflected wave 2 are coupled in reverse phase in the step portion of the space between the electrode faces, thereby cancelling the emitted waves. As a result, the hyper NRD guide and the normal NRD guide can be converted with no problem of reflection.

The above example described the configurations and conversion portion of the hyper NRD guide and the normal NRD guide on the fixed portion side, but the moving side is the same.

FIGS. 10A to 10D show sizes of all the portions when the directional coupler described above is configured as an 0 dB directional coupler, and FIG. 11 shows its characteristics.

Figure 10A:
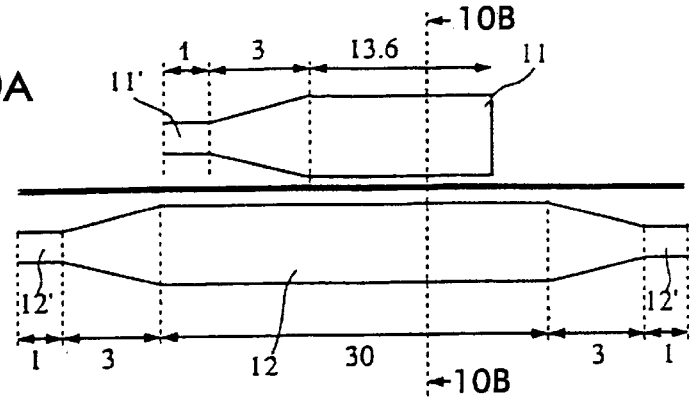
FIGS. 10A to 10D are diagrams showing example dimensions of each part of a directional coupler.
Figure 10B:
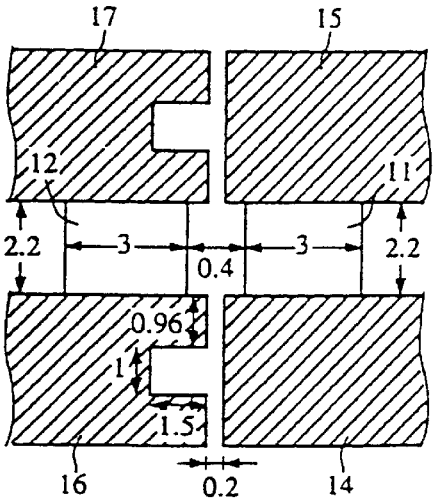
Figure 10C:
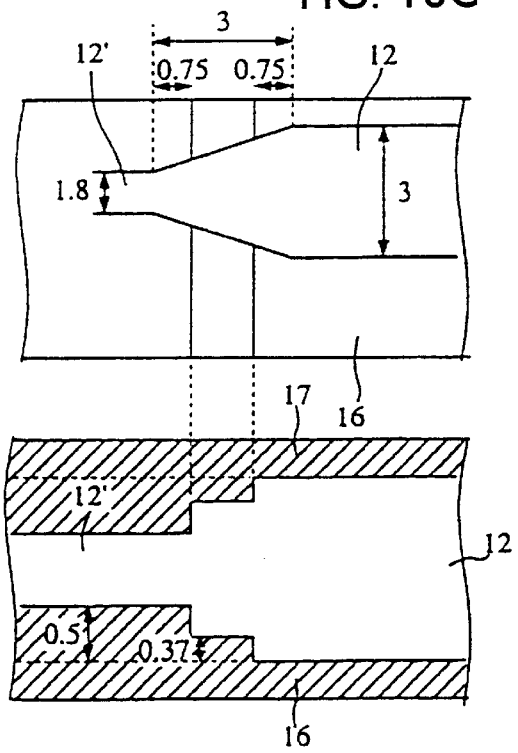
Figure 10D:
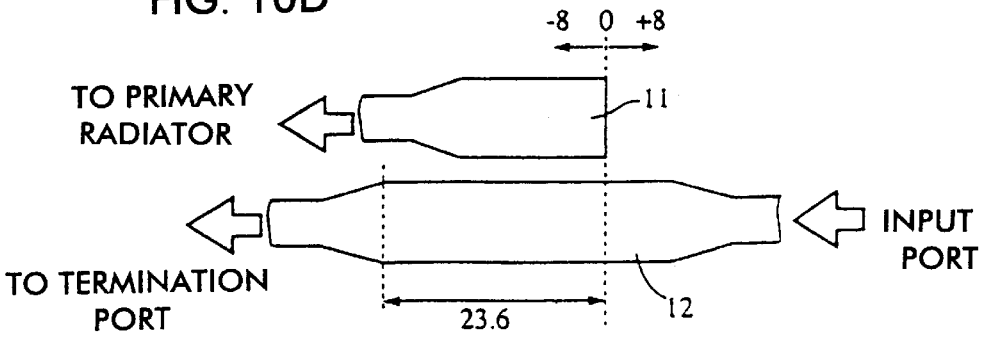

FIGS. 10A to 10D show the dimensions of all the portions in millimeters. FIG. 10A is a top view when the upper conductive plate is removed, FIG. 10B is a cross-sectional view taken along the line A—A of FIG. 10B, and FIG. 10C is a top view of the guide converter portion of the normal NRD guide and the hyper NRD guide and a cross-sectional view of the area near it. Finally, FIG. 10D is a diagram showing the original position of the moving portion.

Figures 11A, 11B, 11C:
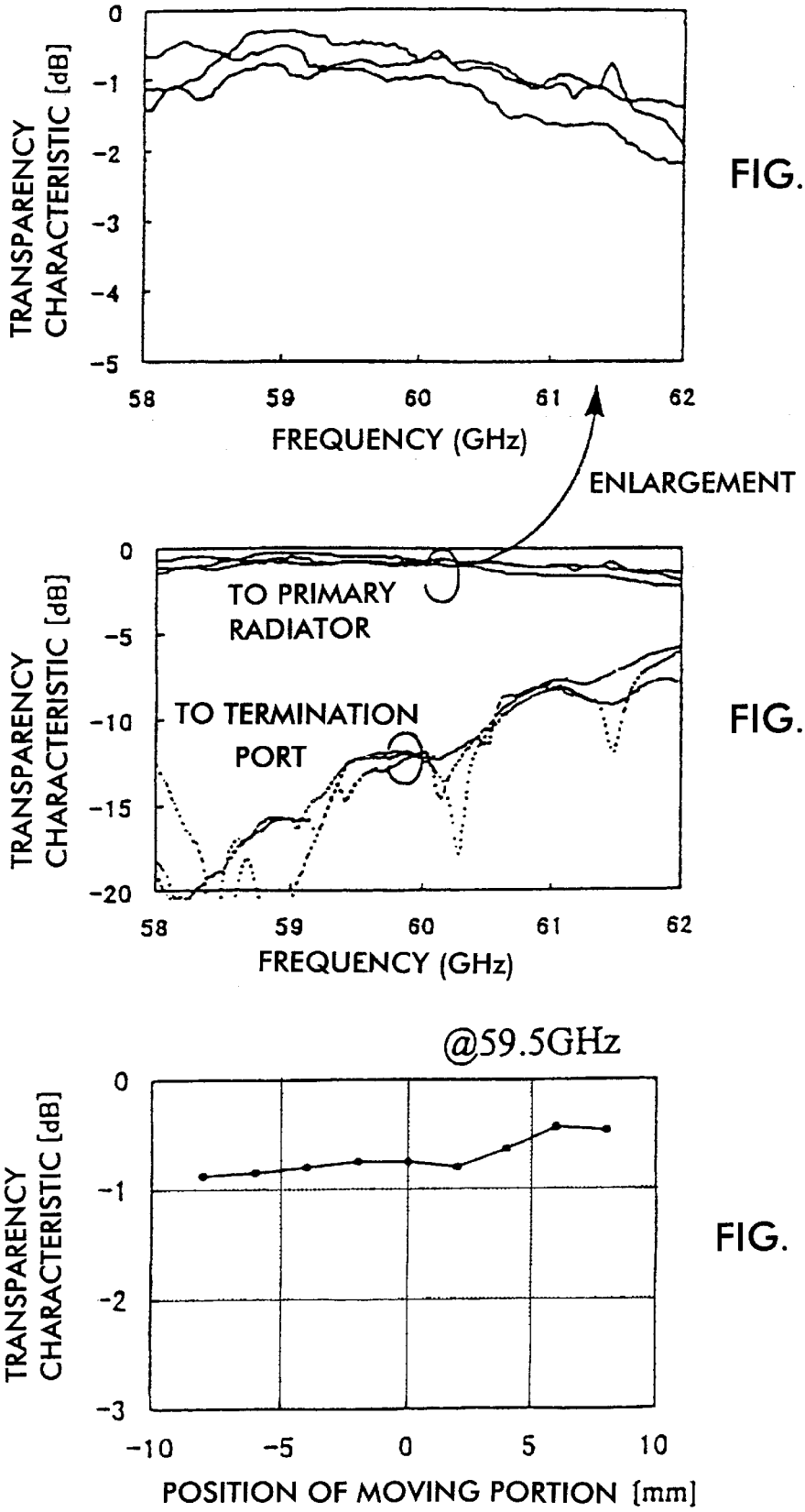
FIGS. 11A to 11C are diagrams showing characteristics of the same directional coupler.

FIG. 11 is a diagram showing transparency characteristics of the directional coupler when the moving portion has been displaced by −8 mm, 0 mm and +8 mm to three different positions, FIG. 11A showing the transparency characteristics at each frequency, FIG. 11B being an enlarged view of the transparency characteristics to the primary emitter, and FIG. 11C showing changes in the transparency characteristics in relation to the position of the moving portion at 59.5 GHz. Even when the moving portion is moved across such a comparatively wide range of frequencies, power can be split at approximately 0 dB. 0 dB is not achieved since, in addition to deviation in the power split, there are also guide loss and transmission loss.

Next, other examples of configurations of a directional coupler will be explained with reference to FIG. 12A to FIG. 14B.

Figure 12A:
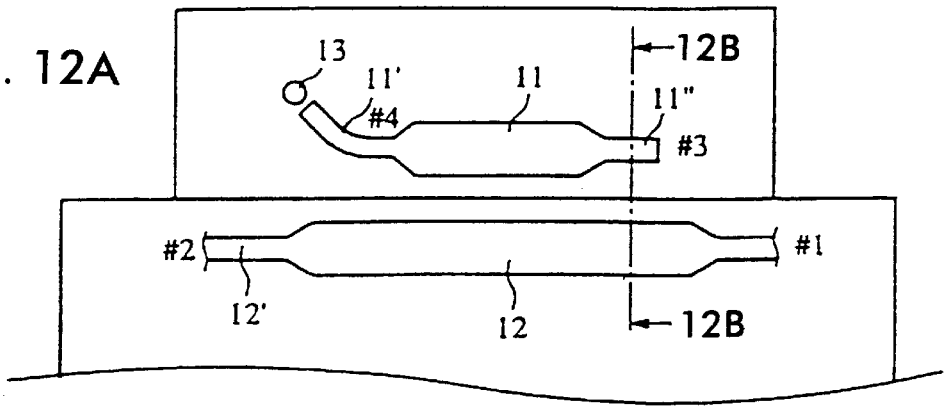
FIGS. 12A to 12C are diagrams showing a configuration of a directional coupler according to a second embodiment.
Figure 12B:
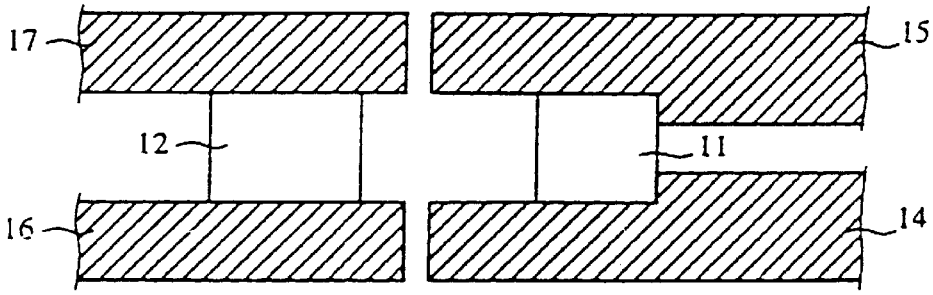
Figure 12C:
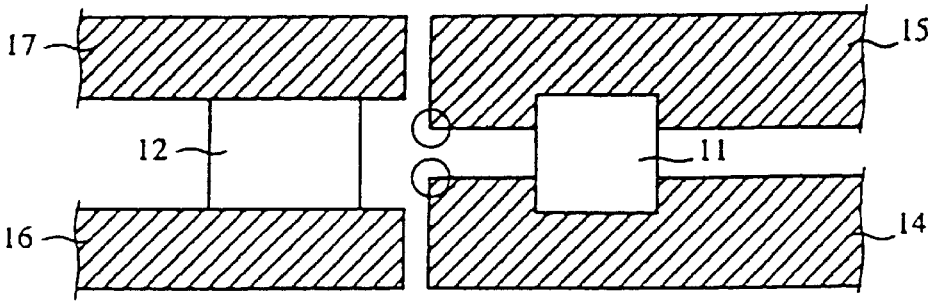

FIG. 12A is a top view of the state when the upper conductive plate is removed, and FIG. 12B is a cross-sectional view taken along the line A—A in FIG. 12A. FIG. 12C is a cross-sectional view as a comparative example. In contrast to the case shown in FIG. 1, in this example, one portion 11' of the dielectric strip 11 of the NRD guide on the moving portion side is a hyper NRD guide, and the other end portion 11" is also a hyper NRD guide. With this configuration, since the horizontal widths of both ends of the dielectric strip 11 are small, the dielectric strip 11 can be exactly positioned in its axial direction. Moreover, when this directional coupler is a 0 dB directional coupler, almost no transmission signals are output from the port #1 to the hyper NRD guide using the dielectric strip 11" on the opposite side of the primary emitter 13, and consequently, since there is no need for resistance-termination, it can be used as an open terminal or as a short-circuiting terminal.

However, when the hyper NRD guide is provided close to the dielectric strip 12 of the normal NRD guide on the fixed portion side in this way, a wall (electrical wall) is created close to the dielectric strip 12 as indicated by the symbol O in FIG. 12C, causing coupling from the LSM01 mode to the LSE mode. Therefore, as shown in FIG. 12B, the space between the conductive plates 14 and 15 in the portion which faces the conductive plates 16 and 17 on the fixed portion side is made equal to the space between the electrode faces of the conductive plates 16 and 17. Similarly, the hyper NRD guide portion comprising the dielectric strip 11' which is coupled to the primary emitter 13 is provided close to the normal NRD guide of the fixed portion side, creating an electrical wall, but when the directional coupler is a 0 dB directional coupler, almost no electromagnetic waves propagate through this portion and so there is no problem of coupling to the LSE mode.

Figure 13A:
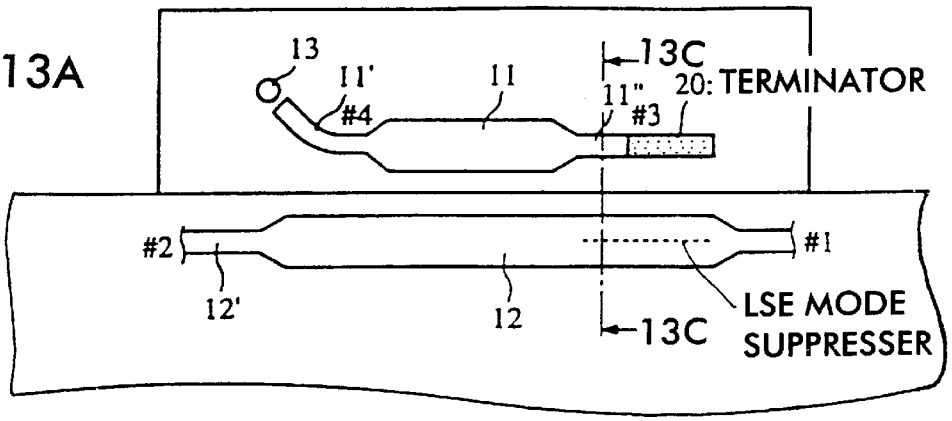
FIGS. 13A to 13C are diagrams showing an example configuration of another directional coupler.
Figure 13B:
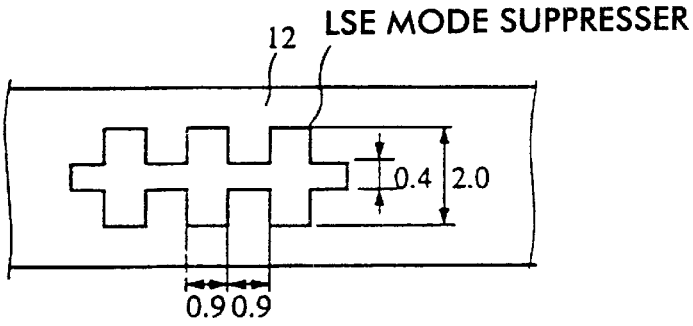
Figure 13C:
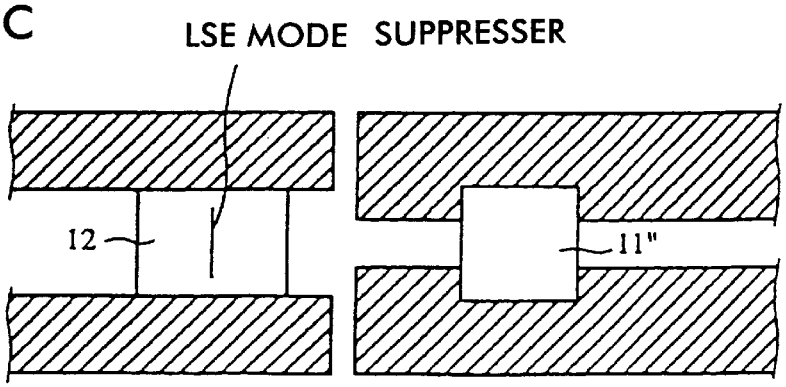

When the hyper NRD guide is parallel to the normal NRD guide, with both left and right sides symmetrically arranged as shown in FIG. 12C, an LSE mode suppresser should be provided inside the dielectric strip 12 of the normal NRD guide which is comparatively close to the hyper NRD guide, as shown in FIG. 13. FIG. 13B is a partially cross-sectional view in the vertical direction through the center of the dielectric strip 12, and FIG. 13C is a cross-sectional view taken along the line A—A of FIG. 13A. An LSE mode suppresser is basically a conductive member provided perpendicular to the electrode faces and parallel to the direction of wave propagation, for preventing LSE mode in this portion. Furthermore, the height of this conductive member is alternately changed to form a filter circuit, thereby ensuring that there is no coupling with the TEM mode. The diagram shows an example at the 60 GHz band, and dimensions are shown in millimeters.

In the example shown in FIG. 13, a terminator 20 is provided to the dielectric strip 11' portion of the hyper NRD guide on the moving portion side. When the terminator 20 is provided to the hyper NRD guide, even when the coupling balance of the directional coupler is slightly inexact, resulting in reflection of waves from the port #3, the effects of such reflection can be reduced.

Furthermore, as shown in FIG. 13, when the terminator 20 is provided to the hyper NRD guide, the terminator portion is a considerable distance away from the dielectric strip 12 of the normal NRD guide on the fixed portion side, ensuring that there is no coupling between them. Consequently, it is not necessary to provide a bend to keep the terminator portion away from the normal NRD guide on the fixed portion side.

In FIGS. 12A to 12C and FIG. 13, the port of the NRD guide comprising the dielectric strip 11' can be used for other purposes. For instance, output terminals may be provided at port #2 and port #3, and transmission signal power and frequency and the like can be monitored from port #2, and the reflection at the antenna terminal can be monitored from port #3.

Figure 14A:
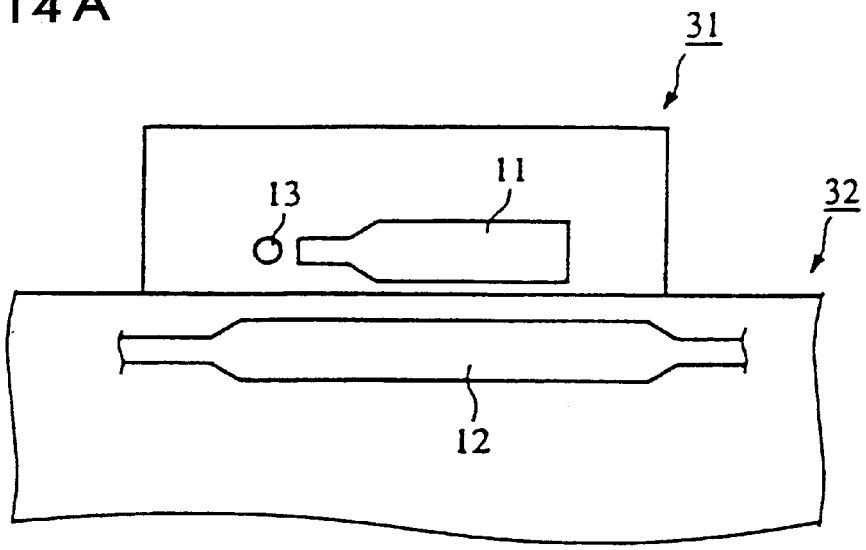
FIGS. 14A and 14B are diagrams showing a configuration of another directional coupler having a differently configured moving portion side.
Figure 14B:
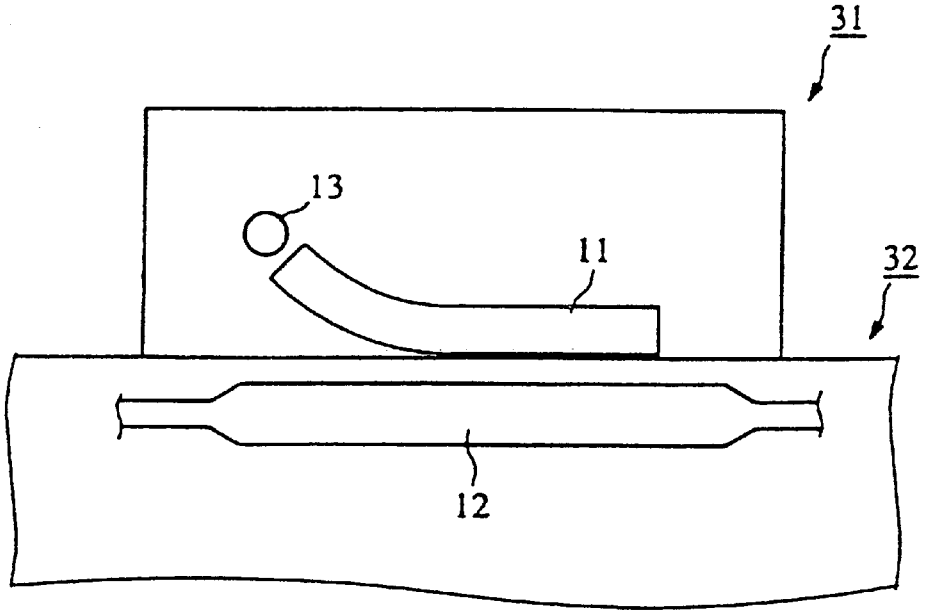

In FIGS. 14A to 14B are diagrams showing other examples of configurations of a directional coupler. In the several examples above, a bend was provided in the hyper NRD guide coupled to the primary emitter on the moving portion side, but as shown in FIG. 14A, the primary emitter can be arranged without a bend. In this case, the polarized wave face of the primary emitter 13 is parallel to the direction in which the moving portion 31 moves. If a bend is provided and the primary emitter 13 is coupled at an angle of 45 degrees as in the previous examples, the electromagnetic wave polarized wave face tilts by 45 degrees. Therefore, the bend portion can be provided to suit the intended purpose.

Furthermore, as shown in FIG. 14B, the entire NRD guide of the moving portion 31 can be a normal NRD guide. This will usually increase the size of the moving portion 31, so the radius of curvature of the bend should be set to minimize transmission loss when switching between modes.

Figure 15:
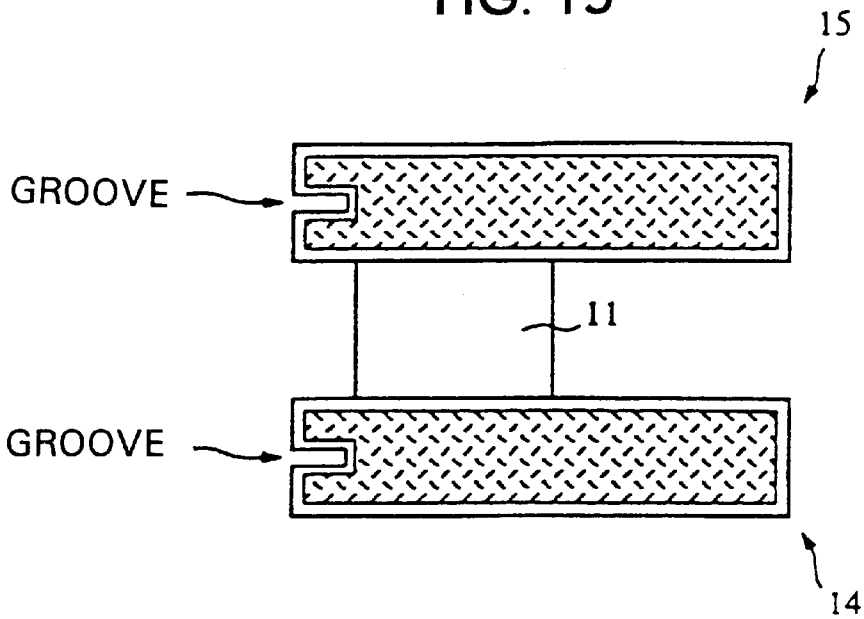
FIG. 15 is a cross-sectional view of the configuration of dielectric guides on a moving portion side.

FIG. 15 is a cross-sectional view of another example configuration of the moving portion side of a directional coupler. In this example, the upper and lower conductive plates 14 and 15 are formed by plating the outer faces of synthetic resin plates with a metal film. When forming the grooves in the moving portion, the base material of the resin should be shaped in advance and the metal plating is applied to all the outer faces thereof, including the inner faces of the grooves. Since the electrode film acting as the NRD guide is on the faces clasping the dielectric strip 11 on either side, it is not essential to provide an electrode film on the outer faces.

Figure 16:
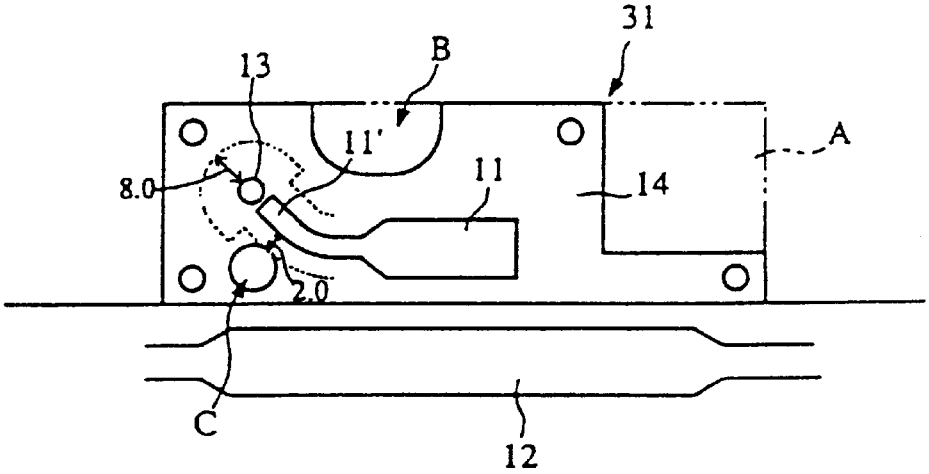
FIG. 16 is a top view of an example configuration of another directional coupler.

FIG. 16 is another example of a configuration of the moving portion, and shows a top view when the upper conductive plate is removed. In this example, the range (area) of the conductive plates has been reduced as far as possible in regions other than the positions of the primary emitter 13 and the dielectric strips 11 and 11' provided to the moving portion 31. To achieve this, notches are provided as shown at A and B, and a hole is provided as shown at C. These should be limited within a range which does not affect the NRD guide characteristics and the primary emitter characteristics. For instance, in the hyper NRD guide portion, the notches and the hole are provided at least 2 mm in the width direction from the dielectric strip 11', and at least 8 mm from the primary emitter 13. In FIG. 16, the secure range is represented by a broken line.

Next, examples of configurations of an antenna device and a transceiver will be explained with reference to FIG. 17 to FIG. 21.

Figure 17:
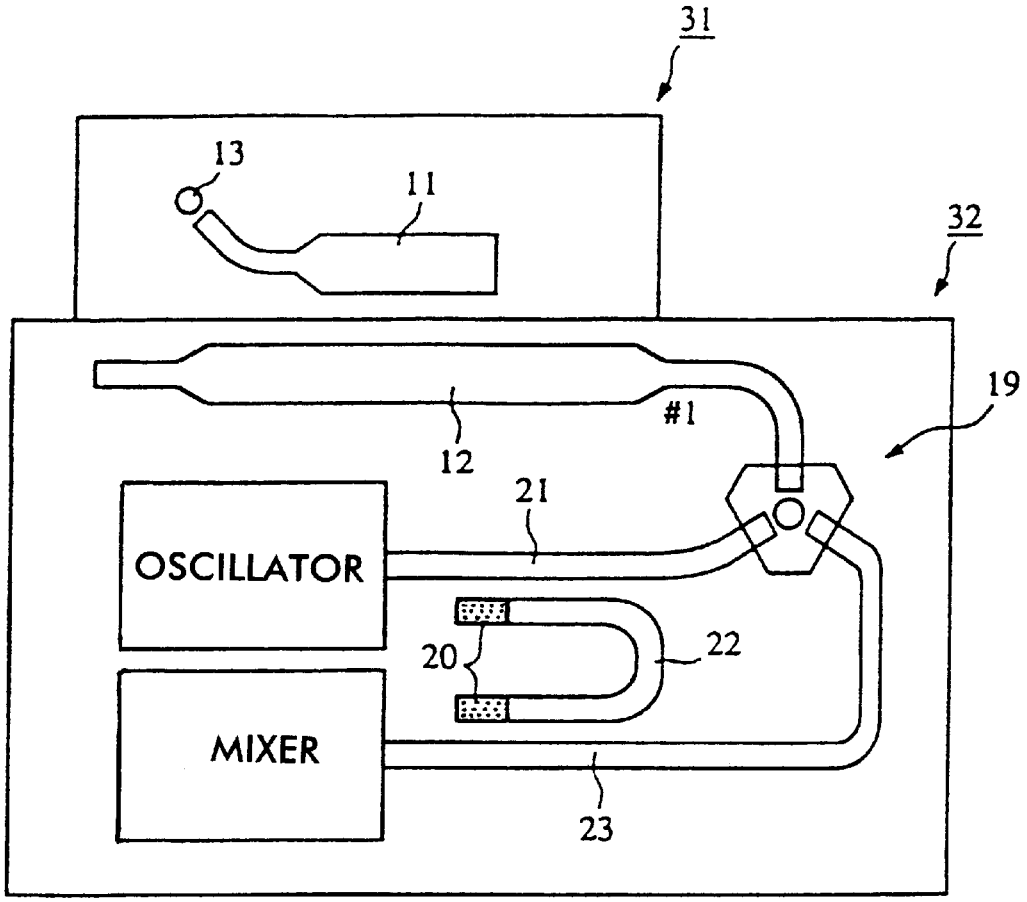
FIG. 17 is a diagram showing a configuration of a transceiver.

FIG. 17 is a top view when the upper conductive plate portion is removed. The configuration of the directional coupler in the moving portion 31 and the fixed portion 32 is the same as FIG. 1. Here, the port #1 is the signal input/output portion of the directional coupler and connects to a circulator 19. A hyper NRD guide comprising a dielectric strip 21 connects to the input port of the circulator 19, and a hyper NRD guide comprising a dielectric strip 23 connects to the output port of the circulator 19. An oscillator is connected to the hyper NRD guide comprising the dielectric strip 21, and a mixer is connected to the hyper NRD guide comprising the dielectric strip 23. A dielectric strip 22 is provided between the dielectric strips 21 and 23 and is coupled to the hyper NRD guides, comprising the dielectric strips 21 and 23 respectively, thereby forming a directional coupler. Terminators 20 are provided at both ends of the dielectric strip 22. Here, the mixer and the oscillator comprising a hyper NRD guide with a substrate in between to provide a circuit for applying bias voltage to these diodes comprises a varactor diode and a Gunn diode.

With the above configuration, the oscillating signal of the oscillator is sent from the dielectric strip 21→the circulator 19→the dielectric strip 12→the dielectric strip 11→the primary emitter 13. Conversely, electromagnetic waves received at the primary emitter 13 are sent from the dielectric strip 11→the dielectric strip 12→the circulator 19→the dielectric strip 23, and are finally input to the mixer. Furthermore, part of the oscillating signal is sent as a local signal to the mixer together with the received signal, via the two directional couplers comprising the dielectric strips 21, 22 and 23. Consequently, the mixer outputs the frequency components of the difference between the transmitted signal and the received signal as an intermediate-frequency signal.

Figure 18:
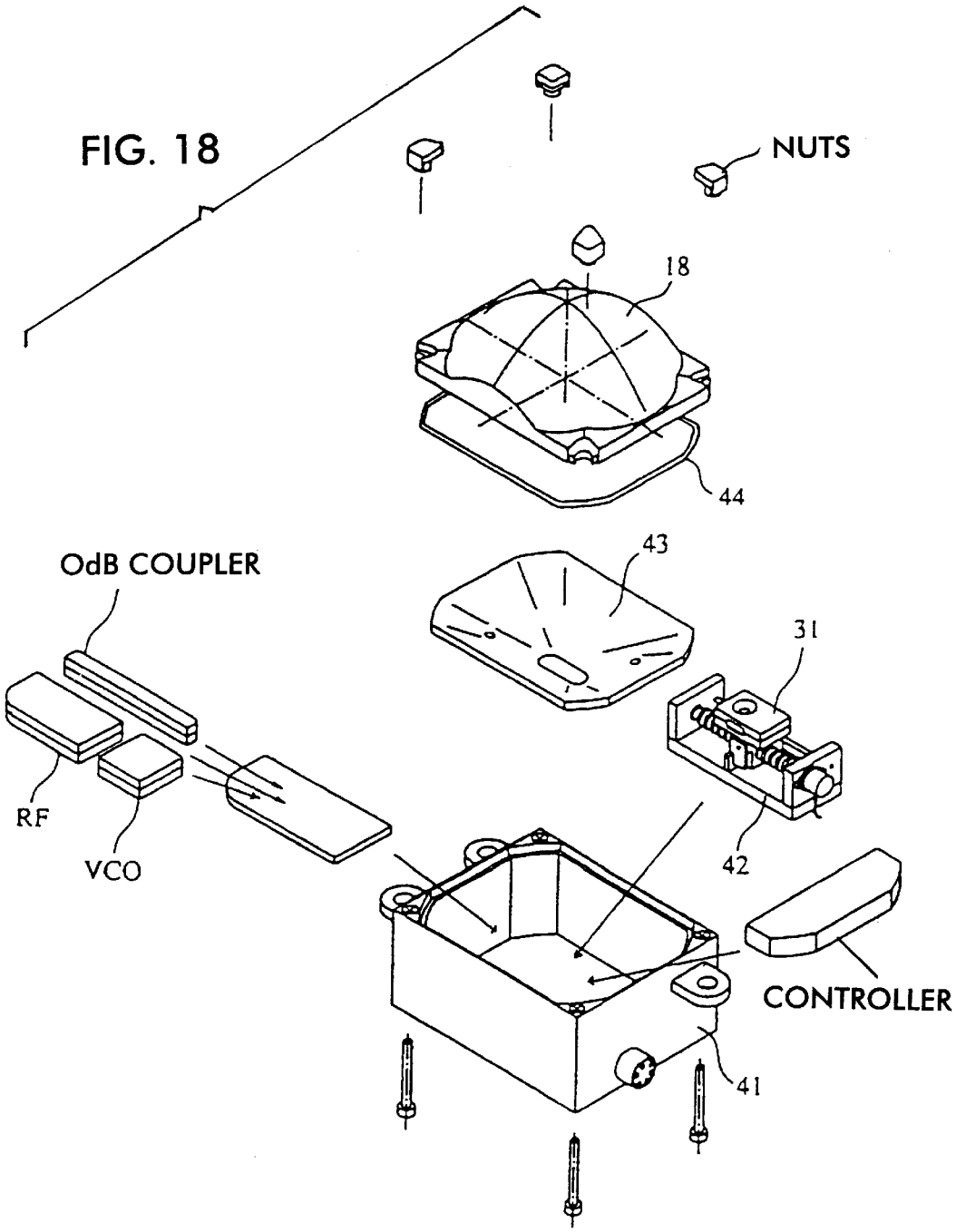
FIG. 18 is an exploded perspective view of a configuration of an antenna device and a transceiver.

FIG. 18 is an exploded perspective view of an overall configuration of a transceiver. In the diagram, a moving portion drive unit 42 for displacing the moving portion 31 will be explained below. A horn 43 has an opening, comprising a long hole extending in the direction which the moving portion 31 is displaced in. The moving portion 31 and a "0 dB coupler" form a directional coupler. A circuit portion RF comprises the above mixer, and a circuit portion VCO comprises the above oscillator. Furthermore, a controller controls the moving portion drive unit 42, extracts information based on the intermediate-frequency signal including the distance, angle and relative speed of the moving portion drive unit 42, and sends these data to an external device. To assemble these portions, all the units are placed in a case 41, the horn 43 is attached, the dielectric lens 18 is placed over this with an O-ring 44 in between, and the entire device is screwed together by four screws which enter from the bottom face of the case 41.

FIG. 19 is a perspective view of the configuration of the moving portion drive unit. In the diagram, one end of a forward screw 54 is attached via a bearing to a frame so that the forward screw 54 can rotate freely. The other end of the forward screw 54 connects to the axis of a pulse motor 55 which is securely screwed to the frame. The frame has a forward guide 51 which is parallel to the forward screw 54, and the forward screw 54 screws into a nut portion which can slide along the forward guide 51. The moving portion 31 has a primary emitter and is securely screwed to the nut portion. Further, an interceptor plate 52 is attached to the nut portion. The frame has a photointerrupter 53, and the interceptor plate 52 passes through the optical axis of the photointerrupter 53.

This forward screw system is basically open-loop controlled, since the moving portion 31 is displaced to a predetermined position by applying a predetermined number of pulses to the pulse motor 55. That is, a CPU controls the pulse of the pulse motor by applying a predetermined number of pulses to the pulse motor, thereby controlling the position of the moving portion. Simultaneously, a memory or register counts the pulse number representing the present position of the moving portion, thereby indirectly detecting the position of the moving portion. Since the position of the moving portion 31 cannot be detected immediately after power injection or when the pulse motor has malfunctioned, in such cases its position is detected using the interceptor plate 52 and the photointerrupter 53.

In the above example, the moving portion was displaced using a rotating motor, but the moving portion can alternatively be displaced using a linear motor. FIGS. 20A and 20B show the configuration of the moving portion drive unit in such a case. FIG. 20A is a perspective view, and FIG. 20B is a cross-sectional view through the face perpendicular to the displacement direction of the moving portion. In FIGS. 20A and 20B, a magnetic circuit comprises external yokes 46 and 47, an internal yoke 45, and magnets 48 and 49, attached to the inner faces of the external yokes 46 and 47. Two guide pins 51 and 51 are secured to the external yoke 47 and are parallel to the internal yoke 45. A moving coil 50 is provided in a single body with a moving push portion, which slides along the guide pins 51 and 51. Simultaneously, the internal yoke 45 passes through the moving coil 50 while maintaining a fixed distance thereto. On the other hand, the moving portion 31 comprising a primary emitter is securely screwed to the moving push portion. An interceptor plate 52 is attached to the moving push portion and has a rhombic window. Two photointerrupters 53*a* and 53*b* are attached to the external yoke 47, so that their optical axes pass through the rhombic window.

In the above voice-coil motor system, the position of the moving portion 31 is detected in accordance with the difference in the amounts of light received by the two photointerrupters 53*a* and 53*b*, and the motor is driven to move the moving portion 31 to a predetermined position.

Figure 21:
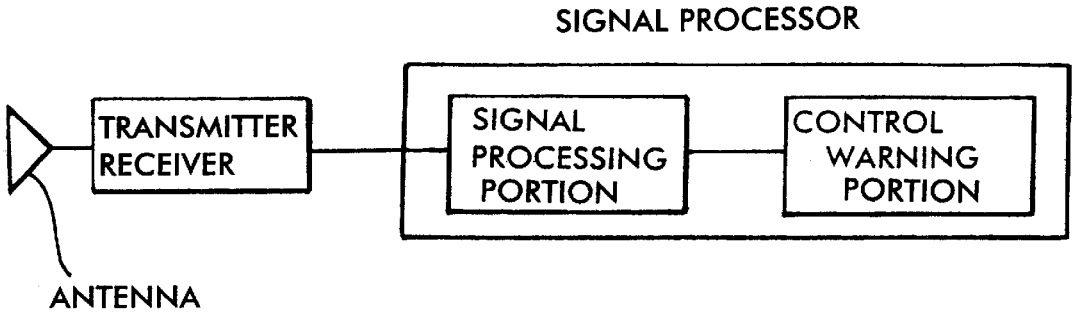
FIG. 21 is a block diagram showing a configuration of a milliwave radar for a vehicle.
Figure 22:
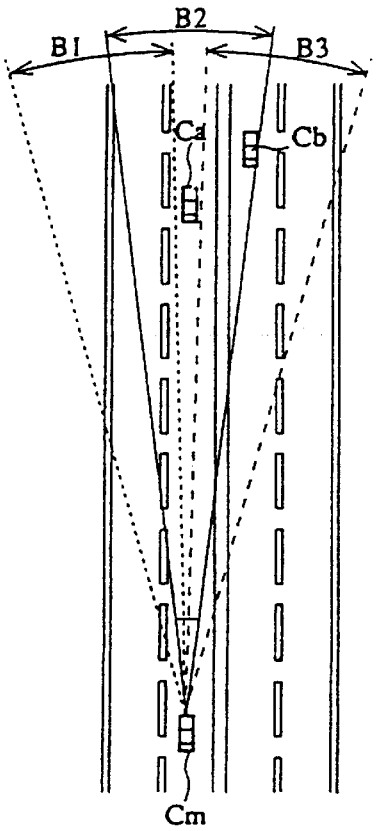
FIG. 22 is a diagram showing the state when the emitted beam of the milliwave radar for a vehicle is tilted horizontally.

FIG. 21 is a block diagram showing an overall configuration of a milliwave radar comprising the antenna device and the transceiver described above. In the diagram, a signal processing portion in a signal processor uses a transceiver to detect numerical data such as, for instance, the relative speed and distance to a vehicle traveling in front. Then, based on the relation between the traveling speed of the main vehicle and the distance between the main vehicle and the vehicle in front, a control/warning portion issues a warning when, for instance, predetermined conditions are satisfied, or issues a warning when the speed relative to the vehicle in front has exceeded a predetermined threshold value.

Next, there will be described an example of optimizing the transparency and reflection characteristics in the portion of the end faces of the conductive plates of the first and second dielectric guides.

Figure 25:
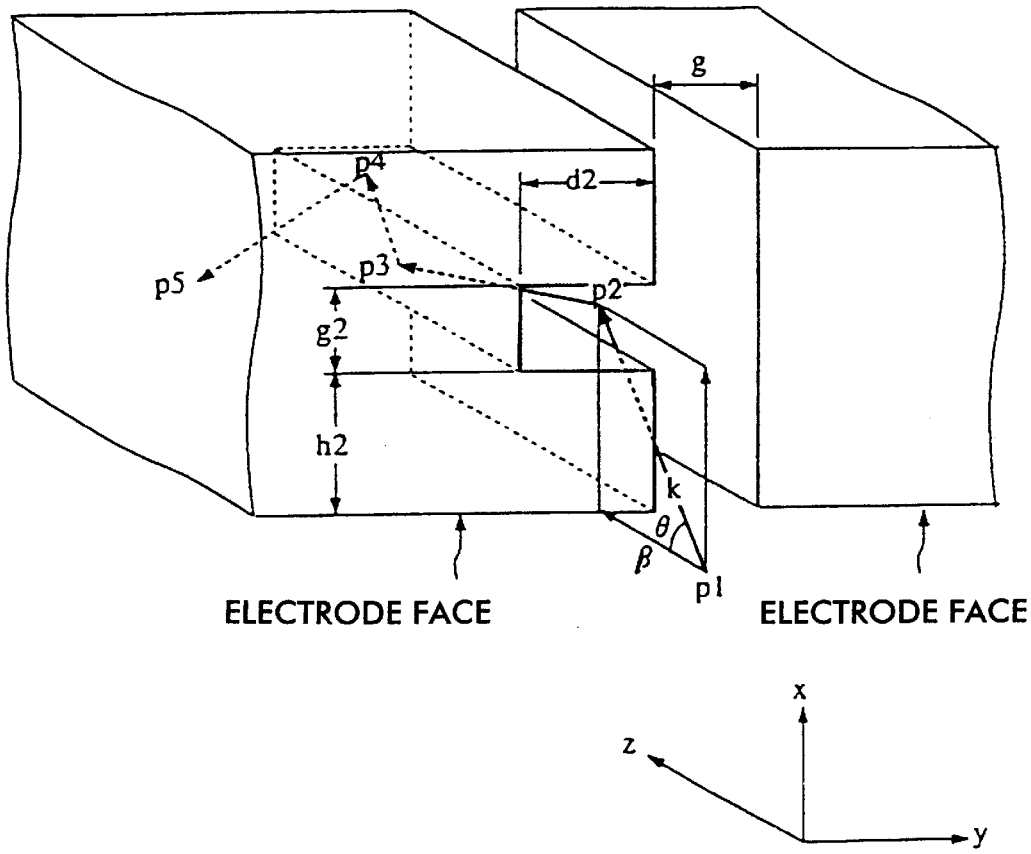
FIG. 25 is a partial perspective view of a configuration of an aligned portion of two upper conductive plates.

FIG. 25 is a partial perspective view of a configuration of the aligned portion of two upper conductive plates. In the diagram, plane waves propagating through the space are considered to include not only waves transmitted perpendicular to the electrode faces (direction x) but also waves propagating parallel to the length of the dielectric guide (the z direction) in the LSM mode, which is a main mode of the NRD guide. That is, plane waves are deemed to propagate in a direction $\theta$ ($=\cos^{-1}(\beta/k)$, determined based on the phase constant $\beta$ of the LSM mode propagating parallel to the length of the dielectric guide and the number k of plane waves propagating through the space, and a groove, which is parallel to the direction of plane waves having this propagation vector, is provided at a distance from the electrode face of approximately an integral multiple of a half wavelength.

In FIG. 25, plane waves propagating from point p1 shift to the y direction of the groove at point p2, and are then reflected from point p3 to point p4. After that, they are reflected yet again until they reach point p5. Here, the points p1 and p5 of FIG. 25 correspond to the points P1 and P2 of FIG. 4, point p2 and p4 correspond to point P2, and point p3 corresponds to point P3 of FIG. 4.

Figure 26:
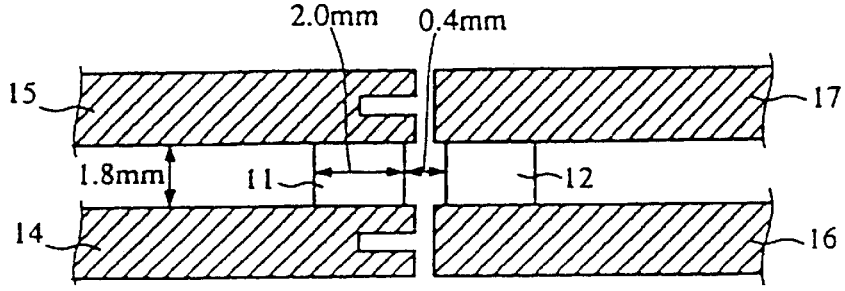
FIG. 26 is a cross-sectional view of a configuration of an aligned portion of the conductive plates.

The number of waves k is determined by $k=\omega\sqrt{(\in\mu)}$. Here, $\omega$ is the frequency, $\in$ is the dielectric constant of the groove, and $\mu$ is the permeability of the groove. Particularly, in air, $k=\omega\sqrt{(\in o\mu o)}$. When the dimensions and position of the dielectric strip at the aligned portion of the conductive plates are as shown in FIG. 26, the dimensions of the portions of FIG. 25 in a 76 GHz band are g=0.2 mm, g2=1.0 mm, h2=1.07 mm, d2=1.6 mm.

Figure 27:
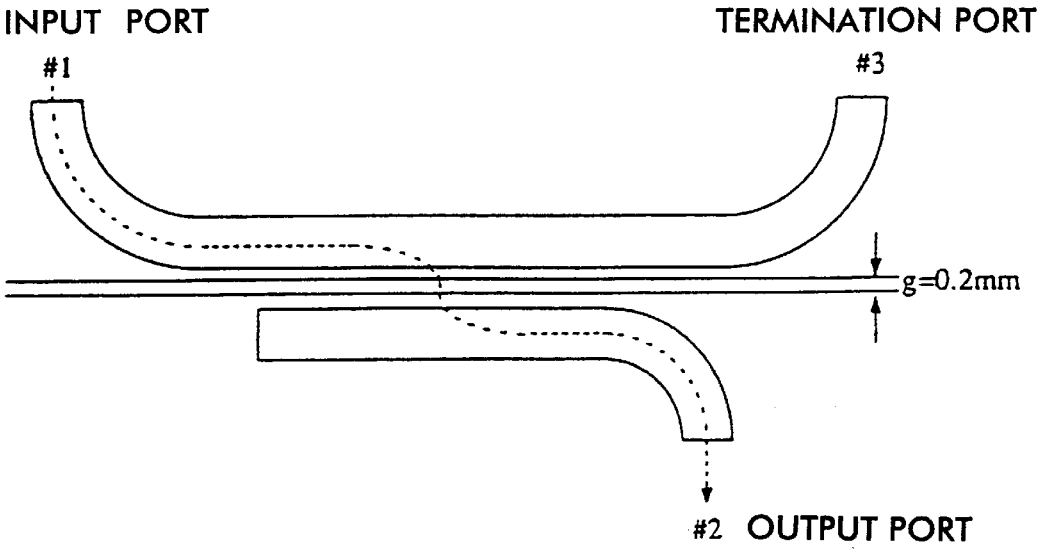
FIG. 27 is a diagram defining ports of a directional coupler.
Figure 28:
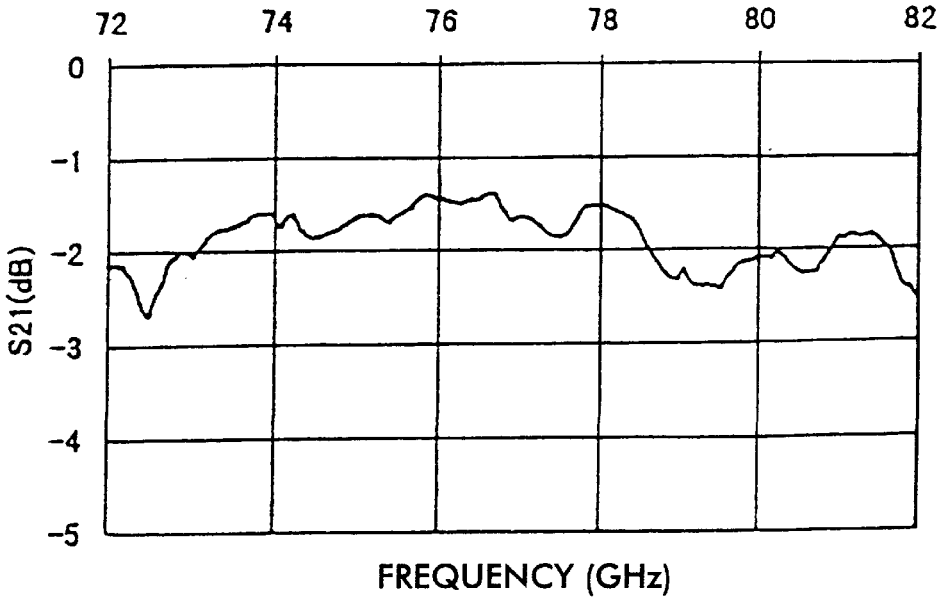
FIG. 28 is a diagram showing measurements of transparency characteristics of a directional coupler.

FIG. 28 shows measurements of the characteristics of the directional coupler at this time. Here, the ports of the directional coupler are defined as in FIG. 27. Fluorine resin with a specific dielectric constant of 2.04 was used as the dielectric material.

Figure 29A:
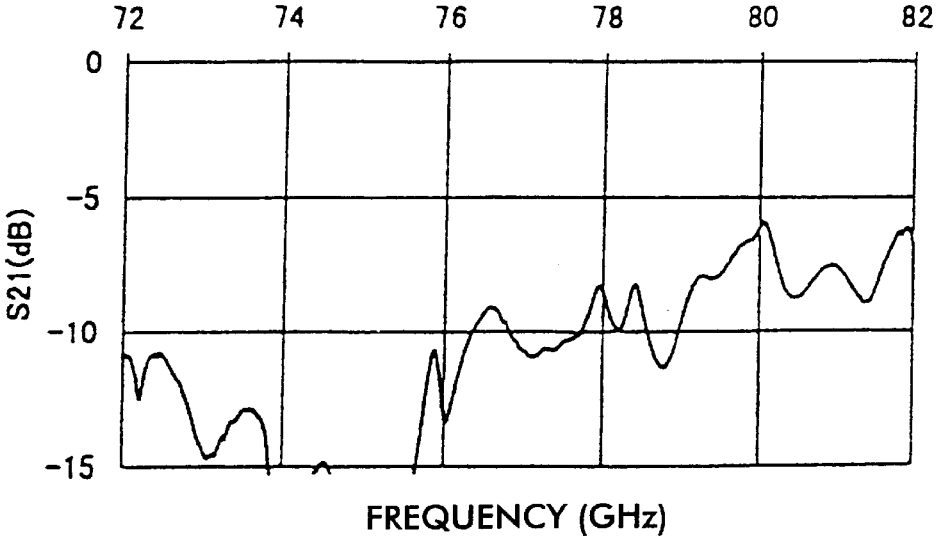
FIGS. 29A and 29B are diagrams showing measurements of transparency characteristics of a directional coupler as a comparative example.
Figure 29B:
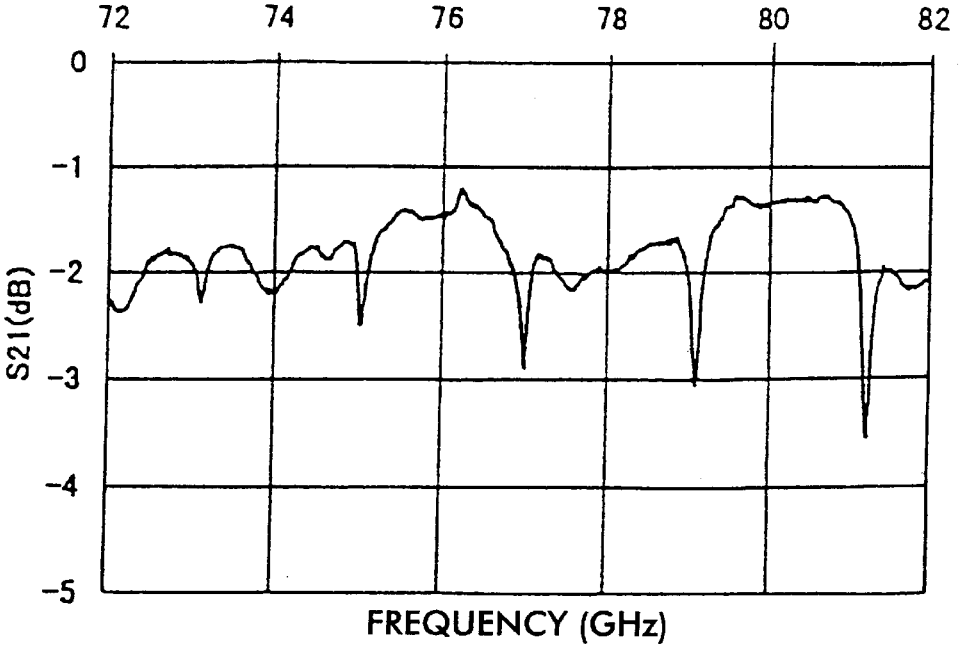

Thus, stable transparency characteristics can be obtained with low loss over a wide band of frequencies centering around 76 GHz. By way of comparison, FIG. 29A shows the transparency characteristic when no groove is provided. When no groove is provided, the transparency characteristic is extremely poor. Furthermore, FIG. 29B shows the transparency characteristic only for waves which are propagating in the direction perpendicular to the electrode face (x direction), in a case where the dimensions of the groove are g=0.2 mm, g2=1.0 mm, h2=0.7 mm and d2=1.22 mm. When the groove does not have appropriate dimensions, the LSM mode converts to the LSE mode at certain frequencies (in the example shown, approximately 73 GHz, 75 GHz, 77 GHz, 79 GHz, 81 GHz), resulting in severe loss.

According to the present invention, although the aligned portions of end faces of conductive plates of first and second dielectric guides are separated, the device functions with the electrode faces of both conductive plates being equivalently continuous, and so there is almost no loss in the space between the conductive plates. Furthermore, since there is almost no reflection in the space, there are no spurious modes caused by reflection.

A short-circuiting face is provided in an optimum position in correspondence with the direction of plane waves propagating through the portion where the end faces of the conductive plates of the first and second dielectric guides are aligned, whereby reflection in the aligned portion of the conductive plates can be most effectively reduced.

Furthermore, according to a first type of nonradiative dielectric guide portion, coupling is possible without making the space between dielectric strips extremely narrow. In addition, according to a second type of nonradiative dielectric guide portion, even though a bend of small radius of curvature is provided, there is no conversion from LSM mode to LSE, whereby the entire device can easily be made small without increasing transmission loss.

The present invention provides an antenna device wherein the direction of the beam is tilted by relatively displacing a first dielectric guide with respect to a second dielectric guide, so that there is low loss in the directional coupler portion. Moreover, by providing first and second types of nonradiative dielectric guide portions on the dielectric guide side, the moving portion can be made small and of low mass, so that the beam can be tilted quickly even when a low-torque motor is used. Furthermore, by providing first and second types of nonradiative dielectric guide portions on the second dielectric guide side, an antenna device which is miniturized overall can be obtained.

According to the present invention, transmission signals and received signals can be electrically transmitted with maximum efficiency between a moving portion and a fixed portion, increasing the efficiency of the antenna.

The present invention also provides a miniturized antenna for transmitting and receiving, wherein the direction of the beam can be tilted using a single primary emitter and a single directional coupler.

Furthermore, the present invention provides a transceiver which is miniturized and has low loss.

What is claimed is:

1. A directional coupler comprising:

first and second dielectric guides, each comprising a dielectric strip provided between two conductive plates and using opposing faces of said two conductive plates as electrode faces, the conductive plates having end faces substantially perpendicular to the opposing faces, said first and second dielectric guides being arranged with end faces of their respective conductive plates touching or not touching, the dielectric strips of said first and second dielectric guides being provided substantially parallel to each other in the vicinity of the end faces of said conductive plates, and a groove being provided in an end face of said conductive plates of one of said first and second dielectric guides, the groove having a short-circuiting face in a position at a distance from said electrode faces of approximately an integral multiple of half the wavelength of a propagated wave.

2. The directional coupler according to claim 1, wherein said position at a distance of approximately an integral multiple of half the wavelength of a propagated wave is a position at a distance from said electrode face of approximately an integral multiple of half the wavelength of a plane wave having a wave-number vector component equal to a phase constant of a transmitted wave propagating through said dielectric guides, in the direction of the transmitted wave.

3. The directional coupler according to claim 1, further comprising a first type of nonradiative dielectric guide comprising said approximately parallel dielectric strip portions and said electrode faces, and a second type of nonradiative dielectric guide, wherein the space between said electrode faces other than those of said approximately parallel dielectric strip portions is narrower than the height of said approximately parallel dielectric strip portions, and comprising a dielectric strip portion other than said approximately parallel dielectric strip portions and said electrode faces, and transmitting in a single LSM01 mode; and a guide conversion portion for said first and second types of nonradiative dielectric guides being provided between said first type of nonradiative dielectric guide and said second type of nonradiative dielectric guide.

4. An antenna device comprising the directional coupler according to claim 1, a primary emitter coupled to a first dielectric guide of said directional coupler, and a dielectric lens provided approximately at the focal point of said primary emitter and secured to a second dielectric guide of said directional coupler.

5. The antenna device according to claim 4, wherein the amount of coupling between said first dielectric guide and said second dielectric guide of said directional coupler is approximately 0 dB.

6. The antenna device according to claim 4, wherein a transmission signal is sent from a transmitter to said second dielectric guide, and input/output ports of a circulator, which sends a received signal from said second dielectric guide to a receiver, are connected to said second dielectric guide.

7. A transceiver comprising a transmitter, connected to an input port of the circulator in the antenna device according to claim 6, and a receiver, connected to an output port of said circulator in said antenna device.

* * * * *